US006206645B1

(12) United States Patent
Pringle

(10) Patent No.: US 6,206,645 B1
(45) Date of Patent: Mar. 27, 2001

(54) VARIABLE ORIFICE GAS LIFT VALVE FOR HIGH FLOW RATES WITH DETACHABLE POWER SOURCE AND METHOD OF USING

(75) Inventor: Ronald E. Pringle, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 09/545,292

(22) Filed: Apr. 7, 2000

Related U.S. Application Data

(62) Division of application No. 08/912,150, filed on Aug. 15, 1997.
(60) Provisional application No. 60/023,965, filed on Aug. 15, 1996.

(51) Int. Cl.[7] ..... F04F 1/20
(52) U.S. Cl. ..... 417/54; 137/155
(58) Field of Search ..... 137/155; 417/54

(56) References Cited

U.S. PATENT DOCUMENTS

| | | |
|---|---|---|
| Re. 36,566 | 2/2000 | Pringle . |
| 3,280,914 | 10/1966 | Sizer et al. . |
| 4,239,082 | 12/1980 | Terral . |
| 4,705,062 | 11/1987 | Baker . |
| 5,172,717 | 12/1992 | Boyle et al. . |
| 5,176,164 | 1/1993 | Boyle . |
| 5,469,878 | 11/1995 | Pringle . |
| 5,535,767 | 7/1996 | Schnatzmeyer et al. . |
| 5,782,261 | 7/1998 | Becker et al. . |

*Primary Examiner*—Gerald A. Michalsky
(74) *Attorney, Agent, or Firm*—Goldstein & Healey LLP

(57) ABSTRACT

The present invention is a surface controlled gas lift valve designed for high flow rates and used in a subterranean well, comprising: a valve for sealable insertion in a mandrel, having a variable orifice which alternately permits, prohibits, or throttles fluid flow into the valve, and a detachable and/or remote actuator are disclosed. Methods of actuating the valve include electro-hydraulic, hydraulic, and pneumo-hydraulic, while sensors relay the position of the variable orifice and critical fluid pressures to a panel on the surface. The orifice valve and the actuator while operatively connected, may be separately installed in or retrieved from by either wireline or coiled tubing intervention methods.

16 Claims, 21 Drawing Sheets

31
14
27
46
33
29
49
10
12
10
10
32
17
51
11
11
16
50
8
29
48
31

VARIABLE ORIFICE GAS LIFT VALVE FOR HIGH FLOW RATES WITH DETACHABLE POWER SOURCE AND METHOD OF USING

RELATED APPLICATIONS

This application is a divisional and claims the benefit of U.S. patent application Ser. No. 08/912,150 filed on Aug. 15, 1997, which application claims the benefit of U.S. Provisional Application No. 60/023,965, filed Aug. 15, 1996.

BACKGROUND OF THE INVENTION

1. Field of the Invention

The present invention relates to subsurface well completion equipment and, more particularly, to an apparatus for lifting hydrocarbons from subterranean formations with gas at high production rates. Additionally, embodiments of independent and detachable actuators are disclosed.

2. Description of the Related Art

Artificial lift systems, long known by those skilled in the art of oil well production, are used to assist in the extraction of fluids from subterranean geological formations. The most ideal well for a company concerned with the production of oil, is one that flows naturally and without assistance. Often wells drilled in new fields have this advantage. In this ideal case, the pressure of the producing formation is greater than the hydrostatic pressure of the fluid in the wellbore, allowing the well to flow without artificial lift. However, as an oil bearing formation matures, and some significant percentage of the product is recovered, a reduction in the formation pressure occurs. With this reduction in formation pressure, the hydrocarbon issuance therefrom is likewise reduced to a point where the well no longer flows without assistance, despite the presence of significant volumes of valuable product still in place in the oil bearing stratum. In wells where this type of production decrease occurs, or if the formation pressure is low from the outset, artificial lift is commonly employed to enhance the recovery of oil from the formation. This disclosure is primarily concerned with one type of artificial lift called "Gas Lift."

Gas lift has long been known to those skilled in the art, as shown in U.S. Pat. No. 2,137,441 filed in November 1938. Other patents of some historic significance are U.S. Pat. Nos. 2,672,827, 2,679,827, 2,679,903, and 2,824,525, all commonly assigned hereto. Other, more recent developments in this field include U.S. Pat. Nos. 4,239,082, 4,360,064 of common assignment, as well as U.S. Pat. Nos. 4,295,796, 4,625,941, and 5,176,164. While these patents all contributed to furthering the art of gas lift valves in wells, recent trends in drilling and completion techniques expose and highlight long felt limitations with this matured technology.

The economic climate in the oil industry of the 1990's demands that oil producing companies produce more oil, that is now exponentially more difficult to exploit, in less time, and without increasing prices to the consumer. One successful technique that is currently being employed is deviated and horizontal drilling, which more efficiently drains hydrocarbon bearing formations. This increase in production makes it necessary to use much larger production tubing sizes. For example, in years past, 2⅜ inch production tubing was most common. Today, tubing sizes of offshore wells range from 4½ to 7 inches. While much more oil can be produced from tubing this large, conventional gas lift techniques have reached or exceeded their operational limit as a result.

In order for oil to be produced utilizing gas lift, a precise volume and velocity of the gas flowing upward through the tubing must be maintained. Gas injected into the hydrostatic column of fluid decreases the column's total density and pressure gradient, allowing the well to flow. As the tubing size increases, the volume of gas required to maintain the well in a flowing condition increases as the square of the increase in tubing diameter. If the volume of the gas lifting the oil is not maintained, the produced oil falls back down the tubing, and the well suffers a condition commonly known as "loading up." If the volume of gas is too great, the cost of compression and recovery of the lift gas becomes a significant percentage of the production cost. As a result, the size of a gas injection orifice in the gas lift valve is of crucial importance to the stable operation of the well. Prior art gas lift valves employ fixed diameter orifices in a range up to ¾ inch, which may be inadequate for optimal production in large diameter tubing. This size limitation is geometrically limited by the gas lift valve's requisite small size, and the position of its operating mechanism, which prevents a full bore through the valve for maximum flow.

Because well conditions and gas lift requirements change over time, those skilled in the art of well operations are also constantly aware of the compromise of well efficiency that must be balanced versus the cost of intervention to install the most optimal gas lift valves therein as well conditions change over time. Well intervention is expensive, most especially on prolific offshore or subsea wells, so a valve that can be utilized over the entire life of the well, and whose orifice size and subsequent flow rate can be adjusted to changing downhole conditions, is a long felt and unresolved need in the oil industry. There is also a need for a novel gas lift valve that has a gas injection orifice that is large enough to inject a volume of gas adequate to lift oil in large diameter production tubing. There is also a need for differing and novel operating mechanisms for gas lift valves that will not impede the flow of injection gas therethrough.

SUMMARY OF THE INVENTION

The present invention has been contemplated to overcome the foregoing deficiencies and meet the above described needs. In one aspect, the present invention is a gas lift valve for use in a subterranean well, comprising: a valve body with a longitudinal bore therethrough for sealable insertion in a mandrel; a variable orifice valve in the body for controlling fluid flow into the body; and, an actuating means connected to the variable orifice valve. Another feature of this aspect of the present invention is that the actuating means may be electro-hydraulically operated, and may further include: a hydraulic pump located in a downhole housing; an electric motor connected to and driving the hydraulic pump upon receipt of a signal from a control panel; hydraulic circuitry connected to and responding to the action of the pump; and, a moveable hydraulic piston responding to the hydraulic circuitry and operatively connected to the variable orifice valve, controlling movement thereof. Another feature of this aspect of the present invention is that the actuating means may further include a position sensor to report relative location of the moveable hydraulic piston to the control panel. Another feature of this aspect of the present invention is that the actuating means may be selectively installed and retrievably detached from the gas lift valve.

Another feature of this aspect of the present invention is that the actuating means may further include at least one pressure transducer communicating with the hydraulic circuitry, and transmitting collected data to the control panel. Another feature of this aspect of the present invention is that the actuating means may further include a mechanical position holder. Another feature of this aspect of the present invention is that the actuating means may be selectively installed and retrievably detached from the gas lift valve.

Another feature of this aspect of the present invention is that the actuating means may be hydraulically operated, and may further include: a hydraulic actuating piston located in a downhole housing and operatively connected to the variable orifice valve; a spring, biasing the variable orifice valve in a full closed position; and, at least one control line connected to the hydraulic actuating piston and extending to a hydraulic pressure source. Another feature of this aspect of the present invention is that the actuating means may further include a position sensor to report relative location of the moveable hydraulic piston to a control panel. Another feature of this aspect of the present invention is that the actuating means may further include at least one pressure transducer communicating with the hydraulic actuating piston, and transmitting collected data to a control panel. Another feature of this aspect of the present invention is that the actuating means may be selectively installed and retrievably detached from the gas lift valve.

Another feature of this aspect of the present invention is that the actuating means may be electro-hydraulic, and may further include: at least one electrically piloted hydraulic solenoid valve located in a downhole housing; at least one hydraulic control line connected to the solenoid valve and extending to a hydraulic pressure source; hydraulic circuity connected to and responding to the action of the solenoid valve; and, a moveable hydraulic piston responding to the hydraulic circuitry and operatively connected to the variable orifice valve, controlling movement thereof. Another feature of this aspect of the present invention is that the actuating means may further include a position sensor to report relative location of the moveable hydraulic piston to a control panel. Another feature of this aspect of the present invention is that the actuating means may further include at least one pressure transducer communicating with the hydraulic circuitry, and transmitting collected data to a control panel. Another feature of this aspect of the present invention is that the actuating means may be selectively installed and retrievably detached from the gas lift valve.

Another feature of this aspect of the present invention is that the actuating means may be pneumo-hydraulically actuated, and may further include: a moveable hydraulic piston having a first and second end, operatively connected to the variable orifice valve, controlling movement thereof; at least one hydraulic control line connected to a hydraulic pressure source and communicating with the first end of the hydraulic piston; and, a gas chamber connected to and communicating with the second end of the hydraulic piston. Another feature of this aspect of the present invention is that the gas lift valve may be retrievably locatable within a side pocket mandrel by wireline and coiled tubing intervention tools. Another feature of this aspect of the present invention is that the gas lift valve may be selectively installed and retrievably detached from the actuating means. Another feature of this aspect of the present invention is that the actuating means may be selectively installed and retrievably detached from the gas lift valve.

In another aspect, the present invention may be a method of using a gas lift valve in a subterranean well, comprising: installing a first mandrel and a second mandrel in a well production string that are in operational communication; retrievably installing a variable orifice gas lift valve in a first mandrel; installing a controllable actuating means in a second mandrel; and, controlling the variable orifice gas lift valve by surface manipulation of a control panel that communicates with the actuating means. Another feature of this aspect of the present invention is that the method of installing the variable orifice gas lift valve and the actuating means may be by wireline intervention. Another feature of this aspect of the present invention is that the method of installing the variable orifice gas lift valve and the actuating means may be by coiled tubing intervention.

In another aspect, the present invention may be a gas lift valve for variably introducing injection gas into a subterranean well, comprising: a valve body with a longitudinal bore therethrough for sealable insertion in a mandrel; a variable orifice valve in the body for controlling flow of injection gas into the body; and, a moveable hydraulic piston connected to the variable orifice valve and in communication with a source of pressurized fluid; whereby the amount of injection gas introduced into the well through the variable orifice valve is controlled by varying the amount of pressurized fluid being applied to the moveable hydraulic piston. Another feature of this aspect of the present invention is that the source of pressurized fluid may be external to the gas lift valve and may be transmitted to the gas lift valve through a control line connected between the gas lift valve and the external source of pressurized fluid. Another feature of this aspect of the present invention is that the external source of pressurized fluid may be located at the earth's surface. Another feature of this aspect of the present invention is that the source of pressurized fluid may be an on-board hydraulic system including: a hydraulic pump located in a downhole housing and in fluid communication with a fluid reservoir; an electric motor connected to and driving the hydraulic pump upon receipt of a signal from a control panel; and, hydraulic circuitry in fluid communication with the hydraulic pump and the hydraulic piston. Another feature of this aspect of the present invention is that the gas lift valve may further include an electrical conduit connecting the control panel to the gas lift valve for providing a signal to the electric motor. Another feature of this aspect of the present invention is that the hydraulic system may further include a solenoid valve located in the downhole housing and connected to the electrical conduit, the solenoid valve directing the pressurized fluid from the hydraulic system through the hydraulic circuitry to the hydraulic piston. Another feature of this aspect of the present invention is that the gas lift valve may further include at least one pressure transducer in fluid communication with the hydraulic circuitry and connected to the electrical conduit for providing a pressure reading to the control panel. Another feature of this aspect of the present invention is that the gas lift valve may further include an upstream pressure transducer connected to the electrical conduit and a downstream pressure transducer connected to the electrical conduit, the upstream and downstream pressure transducers being located within the gas lift valve to measure a pressure drop across the variable orifice valve, the pressure drop measurement being reported to the control panel through the electrical conduit. Another feature of this aspect of the present invention is that the gas lift valve may further include a position sensor to report relative location of the moveable hydraulic piston to the control panel. Another feature of this aspect of the present invention is that the gas lift valve may further include a mechanical position holder to mechanically assure that the variable orifice valve remains in its desired position if conditions in the hydraulic system change during use. Another feature of this aspect of the present invention is that the variable orifice valve may be stopped at intermediate positions between a full open and a full closed position to adjust the flow of injection gas therethrough, the variable orifice valve being held in the intermediate positions by the position holder. Another feature of this aspect of the present invention is that the hydraulic system may further include a movable volume compensator piston for displacing a volume of fluid that is utilized as the hydraulic system operates. Another feature of this aspect of the present invention is that the variable orifice valve may further include a carbide stem and seat. Another feature of this aspect of the present invention is that the mandrel may be provided with at least one injection gas port through which injection gas flows when the variable orifice valve is open. Another feature of this aspect of the present invention is that the gas lift valve may further include an upper and lower one-way check valve located on opposite sides of the variable orifice valve to prevent any fluid flow from the well into the gas lift valve. Another feature of this aspect of the present invention is that the gas lift valve may further include latch means for adapting the variable orifice valve to be remotely deployed and retrieved. Another feature of this aspect of the present invention is that the variable orifice valve may be remotely deployed and retrieved by utilization of coiled tubing. Another feature of this aspect of the present invention is that the variable orifice valve may be remotely deployed and retrieved by utilization of wireline. Another feature of this aspect of the present invention is that the gas lift valve may further include a valve connection collet.

In another aspect, the present invention may be a gas lift valve for variably introducing injection gas into a subterranean well, comprising: a valve body with a longitudinal bore therethrough for sealable insertion in a mandrel; a hydraulic control line connected to the gas lift valve for providing a supply of pressurized fluid thereto; a variable orifice valve in the body for controlling flow of injection gas into the body; a spring biasing the variable orifice valve in a full closed position; a moveable hydraulic piston connected to the variable orifice valve; and, an actuating piston located in a downhole housing, connected to the moveable hydraulic piston and in communication with the control line; whereby the amount of injection gas introduced into the well through the variable orifice valve is controlled by varying the amount of pressurized fluid being applied to the actuating piston. Another feature of this aspect of the present invention is that the control line may be connected to a source of pressurized fluid located at the earth's surface. Another feature of this aspect of the present invention is that the gas lift valve may further include a mechanical position holder to mechanically assure that the variable orifice valve remains in its desired position if conditions in the gas lift valve change during use. Another feature of this aspect of the present invention is that the variable orifice valve may be stopped at intermediate positions between a full open and a full closed position to adjust the flow of injection gas therethrough, the variable orifice valve being held in the intermediate positions by the position holder. Another feature of this aspect of the present invention is that the variable orifice valve may further include a carbide stem and seat. Another feature of this aspect of the present invention is that the mandrel may be provided with at least one injection gas port through which injection gas flows when the variable orifice valve is open. Another feature of this aspect of the present invention is that the gas lift valve may further include an upper and lower one-way check valve located on opposite sides of the variable orifice valve to prevent any fluid flow from the well into the gas lift valve. Another feature of this aspect of the present invention is that the gas lift valve may further include latch means for adapting the variable orifice valve to be remotely deployed and retrieved. Another feature of this aspect of the present invention is that the variable orifice valve may be remotely deployed and retrieved by utilization of coiled tubing. Another feature of this aspect of the present invention is that the variable orifice valve may be remotely deployed and retrieved by utilization of wireline. Another feature of this aspect of the present invention is that the gas lift valve may further include a valve connection collet.

In another aspect, the present invention may be a gas lift valve for variably introducing injection gas into a subterranean well, comprising: a valve body with a longitudinal bore therethrough for sealable insertion in a mandrel; a valve-open and a valve-closed hydraulic control line connected to the gas lift valve for providing dual supplies of pressurized fluid thereto; a variable orifice valve in the body for controlling flow of injection gas into the body; and, a moveable hydraulic piston connected to the variable orifice valve and in fluid communication with the valve-open and valve-closed hydraulic control lines; whereby the variable orifice valve is opened by applying pressure to the hydraulic piston through the valve-open control line and bleeding off pressure from the valve-closed control line; the variable orifice valve is closed by applying pressure to the hydraulic piston through the valve-closed control line and bleeding off pressure from the valve-open control line; and, the amount of injection gas introduced into the well through the variable orifice valve is controlled by varying the amount of pressurized fluid being applied to and bled off from the hydraulic piston through the control lines. Another feature of this aspect of the present invention is that the control lines may be connected to a source of pressurized fluid located at the earth's surface. Another feature of this aspect of the present invention is that the gas lift valve may further include a mechanical position holder to mechanically assure that the variable orifice valve remains in its desired position if conditions in the gas lift valve change during use. Another feature of this aspect of the present invention is that the variable orifice valve may be stopped at intermediate positions between a full open and a full closed position to adjust the flow of injection gas therethrough, the variable orifice valve being held in the intermediate positions by the position holder. Another feature of this aspect of the present invention is that the variable orifice valve may further include a carbide stem and seat. Another feature of this aspect of the present invention is that the mandrel may be provided with at least one injection gas port through which injection gas flows when the variable orifice valve is open. Another feature of this aspect of the present invention is that the gas lift valve may further include an upper and lower one-way check valve located on opposite sides of the variable orifice valve to prevent any fluid flow from the well into the gas lift valve. Another feature of this aspect of the present invention is that the gas lift valve may further include latch means for adapting the variable orifice valve to be remotely deployed and retrieved. Another feature of this aspect of the present invention is that the variable orifice valve may be remotely deployed and retrieved by utilization of coiled tubing. Another feature of this aspect of the present invention is that the variable orifice valve may be remotely deployed and retrieved by utilization of wireline. Another feature of this aspect of the present invention is that the gas lift valve may further including a valve connection collet. Another feature of this aspect of the present invention is that the gas lift valve may further include a fluid displacement port for use during the bleeding off of pressurized fluid from the hydraulic piston. Another feature of this aspect of the present invention is that the gas lift valve may further include a valve-open and a valveclosed conduit for routing pressurized fluid from the valve-open and valve-closed control lines to the hydraulic piston.

Another feature of this aspect of the present invention is that the gas lift valve may further include an electrical conduit connecting a control panel at the earth's surface to the gas lift valve for communicating collected data to the control panel. Another feature of this aspect of the present invention is that the gas lift valve may further include a valve-open pressure transducer and to a valve-closed pressure transducer, the valve-open pressure transducer being connected to the electrical conduit and in fluid communication wit the valve-open conduit, the valve-closed pressure transducer being connected to the electrical conduit and in fluid communication with the valve-closed conduit, the pressure transducers providing pressure readings to the control panel via the electrical conduit. Another feature of this aspect of the present invention is that the gas lift valve may further include an upstream pressure transducer connected to the electrical conduit and a downstream pressure transducer connected to the electrical conduit, the upstream and downstream pressure transducers being located within the gas lift valve to measure a pressure drop across the variable orifice valve, the pressure drop measurement being reported to the control panel through the electrical conduit.

In another aspect, the present invention may be a gas lift valve for variably introducing injection gas into a subterranean well, comprising: a valve body with a longitudinal bore therethrough for sealable insertion in a mandrel; a hydraulic control line connected to the gas lift valve for providing a supply of pressurized fluid thereto; a variable orifice valve in the body for controlling flow of injection gas into the body; a nitrogen coil chamber providing a pressurized nitrogen charge through a pneumatic conduit for biasing the variable orifice valve in a full closed position; and, a moveable hydraulic piston connected to the variable orifice valve and in fluid communication with the hydraulic control line and the pneumatic conduit; whereby the variable orifice valve is opened by applying hydraulic pressure to the hydraulic piston through the hydraulic control line to overcome the pneumatic pressure in the pneumatic conduit; the variable orifice valve is closed by bleeding off pressure from the hydraulic control line to enable the pneumatic pressure in the nitrogen coil chamber to closed the variable orifice valve; and, the amount of injection gas introduced into the well through the variable orifice valve is controlled by varying the amount of hydraulic fluid being bled off from the hydraulic piston through the hydraulic control line. Another feature of this aspect of the present invention is that the hydraulic control line may be connected to a source of pressurized fluid located at the earth's surface. Another feature of this aspect of the present invention is that the gas lift valve may further include a mechanical position holder to mechanically assure that the variable orifice valve remains in its desired position if conditions in the gas lift valve change during use. Another feature of this aspect of the present invention is that the variable orifice valve may be stopped at intermediate positions between a full open and a full closed position to adjust the flow of injection gas therethrough, the variable orifice valve being held in the intermediate positions by the position holder. Another feature of this aspect of the present invention is that the variable orifice valve may further include a carbide stem and seat. Another feature of this aspect of the present invention is that the mandrel may be provided with at least one injection gas port through which injection gas flows when the variable orifice valve is open. Another feature of this aspect of the present invention is that the gas lift valve may further include an upper and lower one-way check valve located on opposite sides of the variable orifice valve to prevent any fluid flow from the well into the gas lift valve. Another feature of this aspect of the present invention is that the gas lift valve may further include latch means for adapting the variable orifice valve to be remotely deployed and retrieved. Another feature of this aspect of the present invention is that the variable orifice valve may be remotely deployed and retrieved by utilization of coiled tubing. Another feature of this aspect of the present invention is that the variable orifice valve may be remotely deployed and retrieved by utilization of wireline. Another feature of this aspect of the present invention is that the gas lift valve may further include a valve connection collet.

In another aspect, the present invention may be a gas lift valve for variably introducing injection gas into a subterranean well, comprising: a first mandrel connected to a second mandrel, the first and second mandrel being installed in a well production string; a valve means having a variable orifice for controlling flow of injection gas into the well, the valve means being installed in the first mandrel; an actuating means for controlling the valve means, the actuating means being installed in the second mandrel, in communication with and controllable from a control panel, and connected to the valve means by a first and second hydraulic control line. Another feature of this aspect of the present invention is that the valve means and the actuating means may be remotely deployed within and retrieved from their respective mandrels. Another feature of this aspect of the present invention is that the valve means and actuating means may be remotely deployed and retrieved by utilization of coiled tubing. Another feature of this aspect of the present invention is that the valve means and actuating means may be remotely deployed and retrieved by utilization of wireline.

Figure 1A:
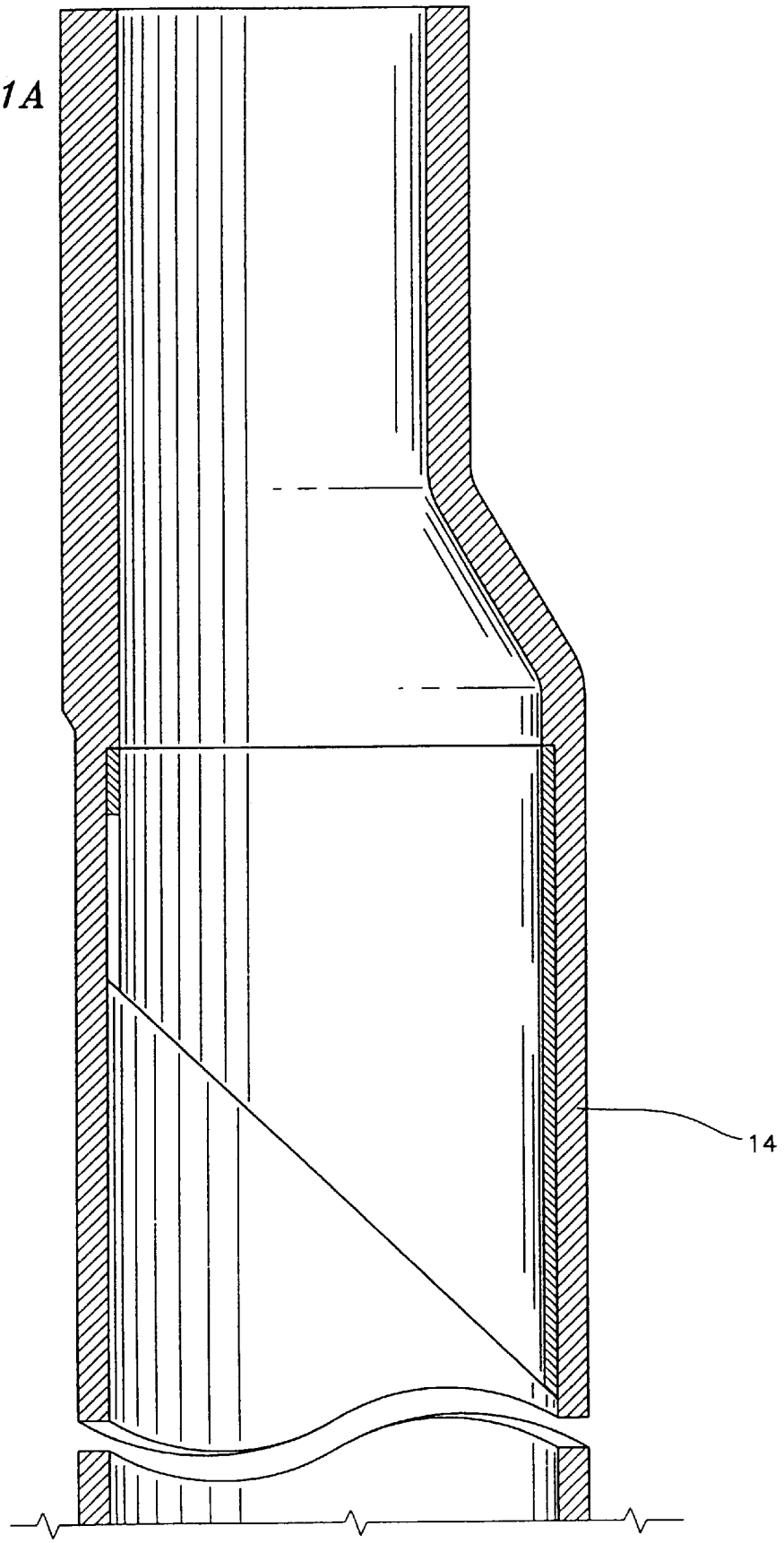
FIGS. 1A–1C are elevation views which together illustrate an electro-hydraulically operated embodiment of the apparatus of the present invention having an on-board hydraulic system and connected to an electrical conduit running from the earth's surface; the power unit is shown rotated ninety degrees for clarity.

While the invention will be described in connection with the preferred embodiments, it will be understood that it is not intended to limit the invention to those embodiments. On the contrary, it is intended to cover all alternatives, modifications, and equivalents as may be included within the spirit and scope of the invention as defined by the appended claims.

DESCRIPTION OF THE PREFERRED EMBODIMENTS

In the description that follows, like parts are marked through the specification and drawings with the same reference numerals, respectively. The figures are not necessarily drawn to scale, and in some instances, have been exaggerated or simplified to clarify certain features of the invention. One skilled in the art will appreciate many differing applications of the described apparatus.

For the purposes of this discussion, the terms "upper" and "lower," "up hole" and "downhole," and "upwardly" and "downwardly" are relative terms to indicate position and direction of movement in easily recognized terms. Usually, these terms are relative to a line drawn from an upmost position at the surface to a point at the center of the earth, and would be appropriate for use in relatively straight, vertical wellbores. However, when the wellbore is highly deviated, such as from about 60 degrees from vertical, or horizontal, these terms do not make sense and therefore should not be taken as limitations. These terms are only used for ease of understanding as an indication of what the position or movement would be if taken within a vertical wellbore.

Figure 1B:
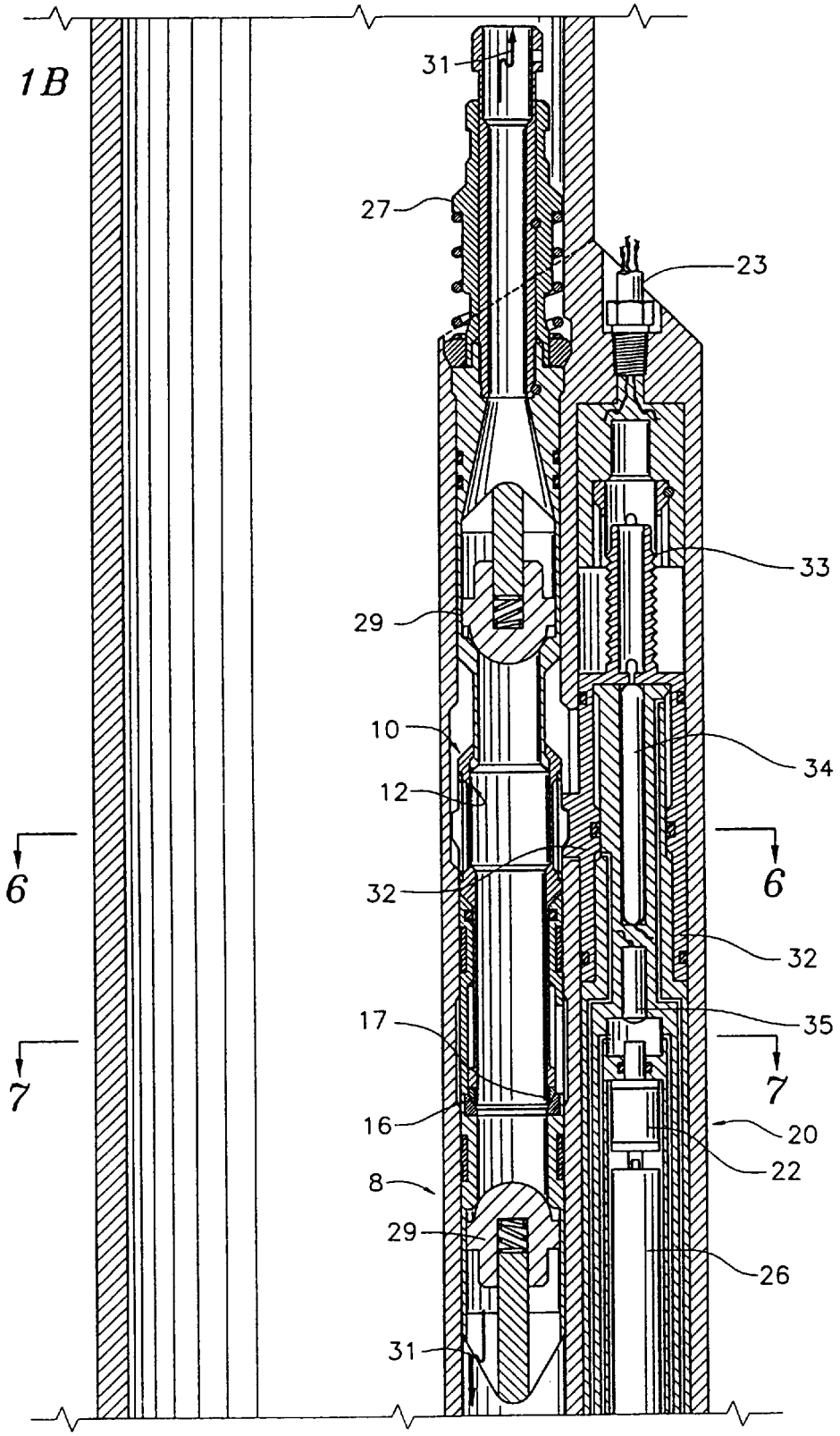
Figure 1C:
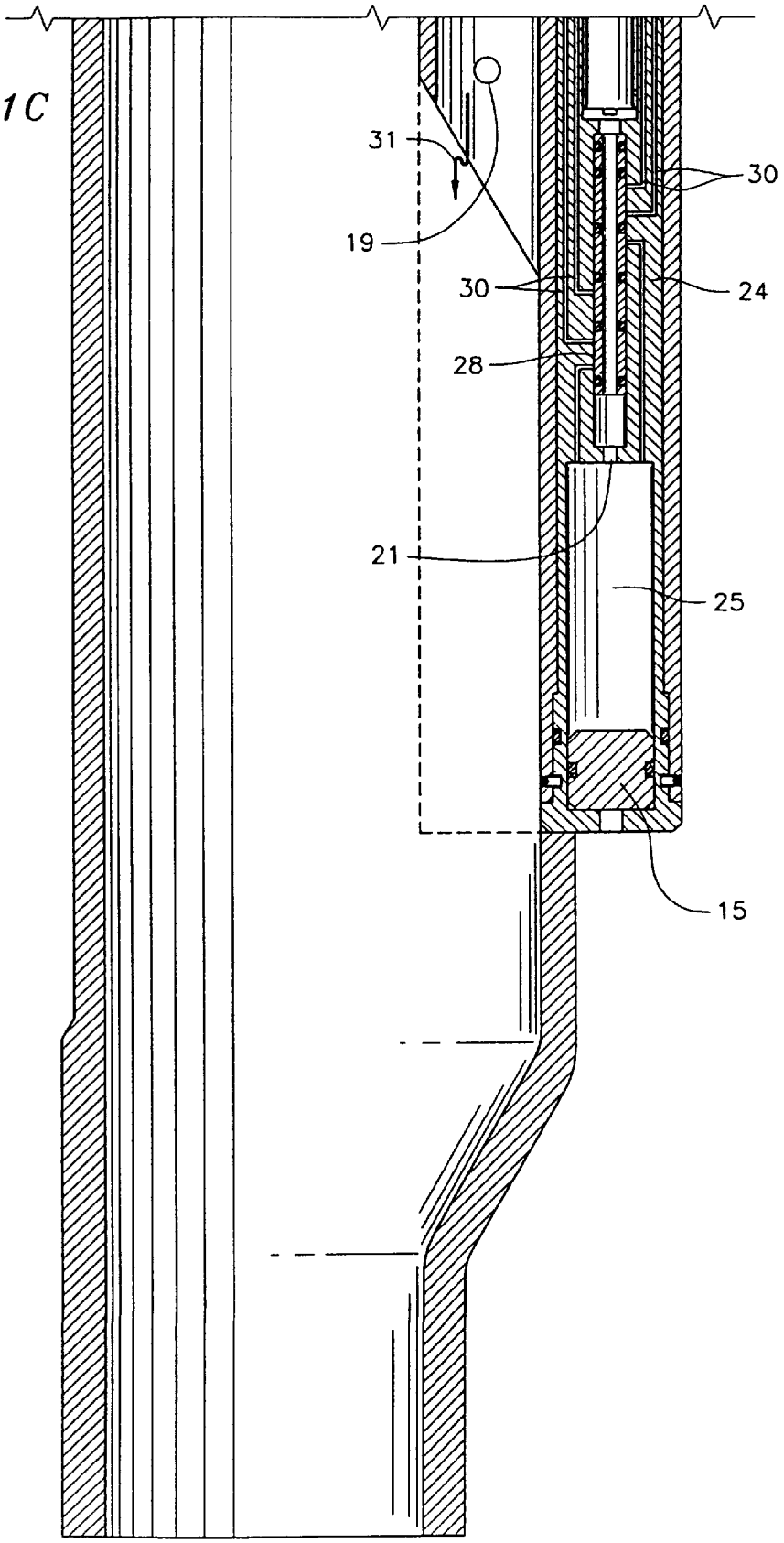
Figure 7:
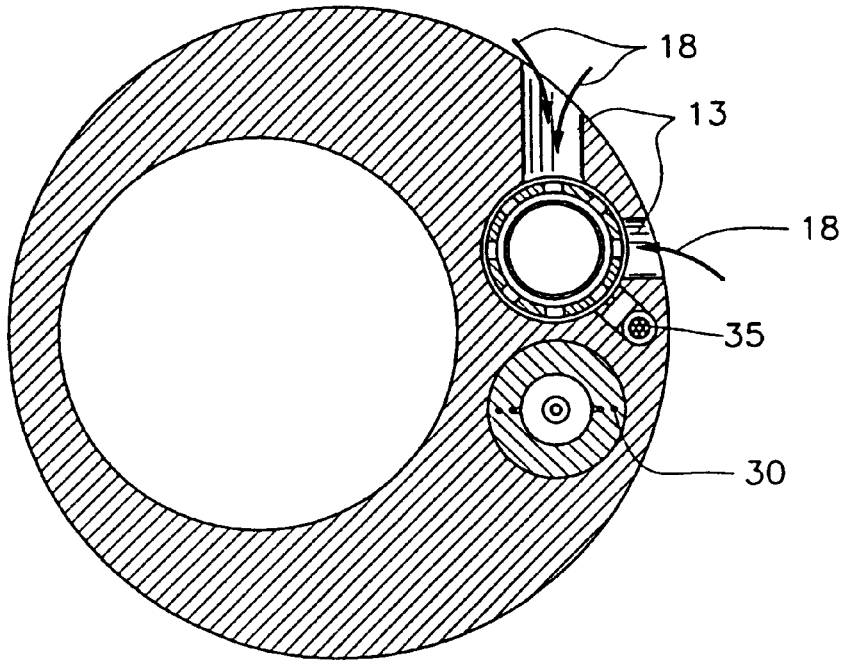
FIG. 7 is a cross-sectional view taken along line 7—7 of FIG. 1B.

FIGS. 1A–1C together show a semidiagrammatic cross section of a gas lift valve 8 shown in the closed position, used in a subterranean well (not shown), illustrating: a valve body 10 with a longitudinal bore 12 for sealable insertion in a side pocket mandrel 14, a variable orifice valve 16 in the body 10 which alternately permits, prohibits, or throttles fluid flow (represented by item 18—see FIG. 7) into said body through injection gas ports 13 in the mandrel 14, and an actuating means, shown generally by numeral 20 which is electro-hydraulically operated using a hydraulic pump 22 located in a downhole housing 24, an electric motor 26 connected to and driving the hydraulic pump 22 upon receipt of a signal through an electrical conduit 23 connected to a control panel (not shown) located at the earth's surface. Also shown is a moveable temperature/volume compensator piston 15 for displacing a volume of fluid that is utilized as the actuating means 20 operates and for compensating for pressure changes caused by temperature fluctuations. A solenoid valve 28 controls the movement of pressurized fluid pumped from a control fluid reservoir 25 through a pump suction port 21 and in a hydraulic circuitry 30, and the direction of the fluid flowing therethrough, which is connected to and responding to the action of the pump 22. A moveable hydraulic piston 32 responding to the pressure signal from the hydraulic circuitry 30 opens and controls the movement of the variable orifice valve 16. The actuator has a position sensor 34 which reports the relative location of the moveable hydraulic piston 32 to the control panel (not shown), and a position holder 33 which is configured to mechanically assure that the actuating means 20 remains in the desired position by the operator if conditions in the hydraulic system change slightly in use. Also shown is a pressure transducer 35 communicating with the hydraulic circuitry 30, and transmitting collected data to the control panel (not shown) via the electrical conduit 23. As shown in FIG. 1C, a downstream pressure transducer 19 may be provided to cooperate with the pressure transducer 35 for measuring and reporting to the control panel any pressure drop across the variable orifice valve 16. It will be obvious to one skilled in the art that the electric motor 26 and downhole pump 22 have been used to eliminate the cost of running a control line from a surface pressure source. This representation should not be taken as a limitation. Obviously, a control line could be run from the surface to replace the electric motor 26 and downhole pump 22, and would be controlled in the same manner without altering the scope or spirit of this invention. When it is operationally desirable to open the variable orifice valve 16, an electric signal from the surface activates the electric motor 26 and the hydraulic pump 22, which routes pressure to the solenoid valve 28. The solenoid valve 28 also responding to stimulus from the control panel, shifts to a position to route hydraulic pressure to the moveable hydraulic piston 32 that opens the variable orifice valve 16. The variable orifice valve 16 may be stopped at intermediate positions between open and closed to adjust the flow of lift or injection gas 31 therethrough, and is held in place by the position holder 33. To close the valve, the solenoid valve 28 merely has to be moved to the opposite position rerouting hydraulic fluid to the opposite side of the moveable hydraulic piston 32, which then translates back to the closed position.

Figure 6:
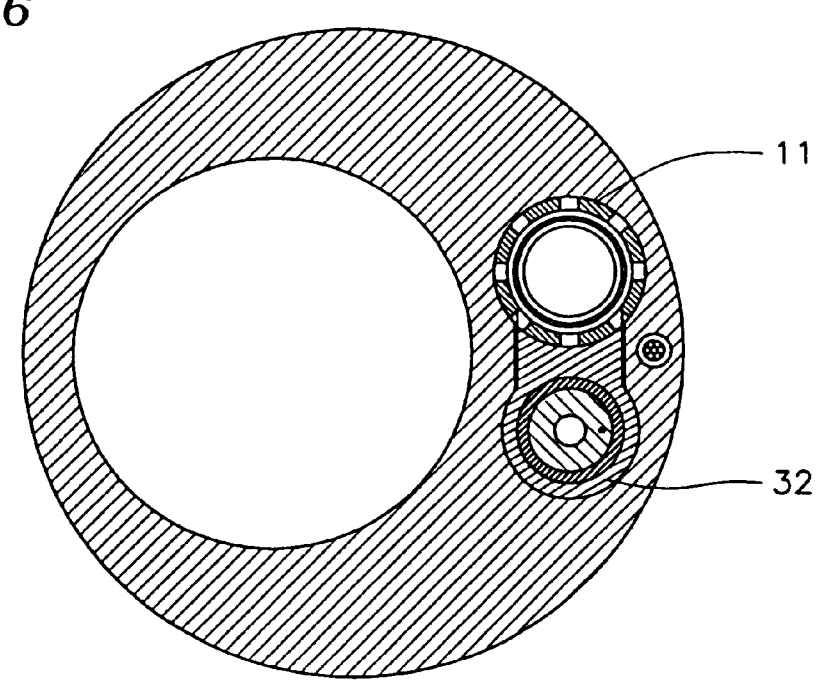
FIG. 6 is a cross-sectional view taken along line 6—6 of FIG. 1B.

As shown in FIG. 1B, the variable orifice valve 16 may include a carbide stem and seat 17. The gas lift valve 8 may also be provided with one-way check valves 29 to prevent any fluid flow from the well conduit into the gas lift valve 8. The gas lift valve 8 may also be provided with a latch 27 so the valve may be remotely installed and/or retrieved by well known wireline or coiled tubing intervention methods. As shown in FIG. 6, this embodiment of the present invention may also be provided with a valve to connection collet 11, the structure and operation of which are well known to those of ordinary skill in the art.

Figure 2A:
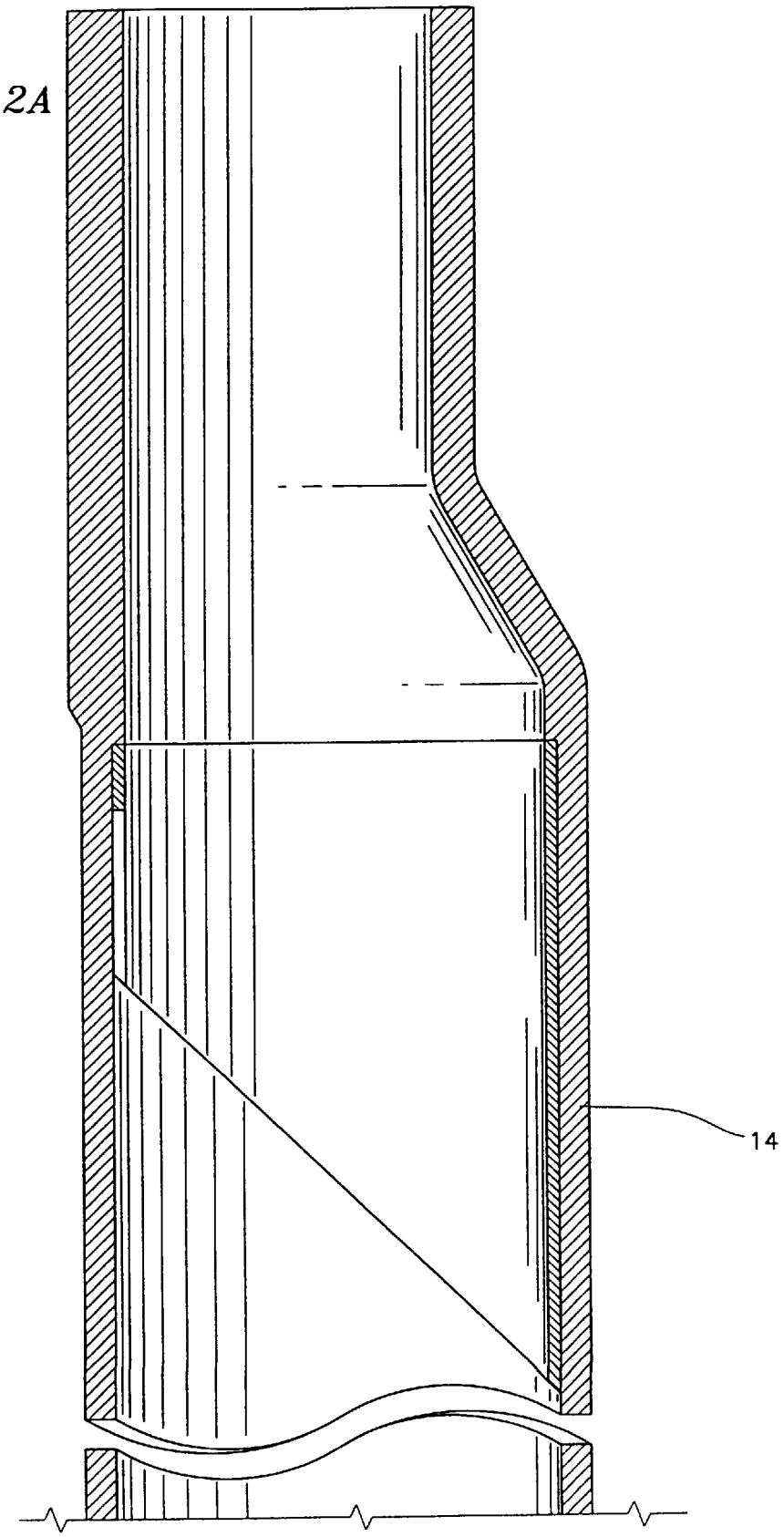
FIGS. 2A–2C are elevation views which together illustrate a hydraulically operated embodiment of the apparatus of the present invention connected to a single hydraulic control line running from the earth's surface; the power unit is shown rotated ninety degrees for clarity.
Figure 2B:
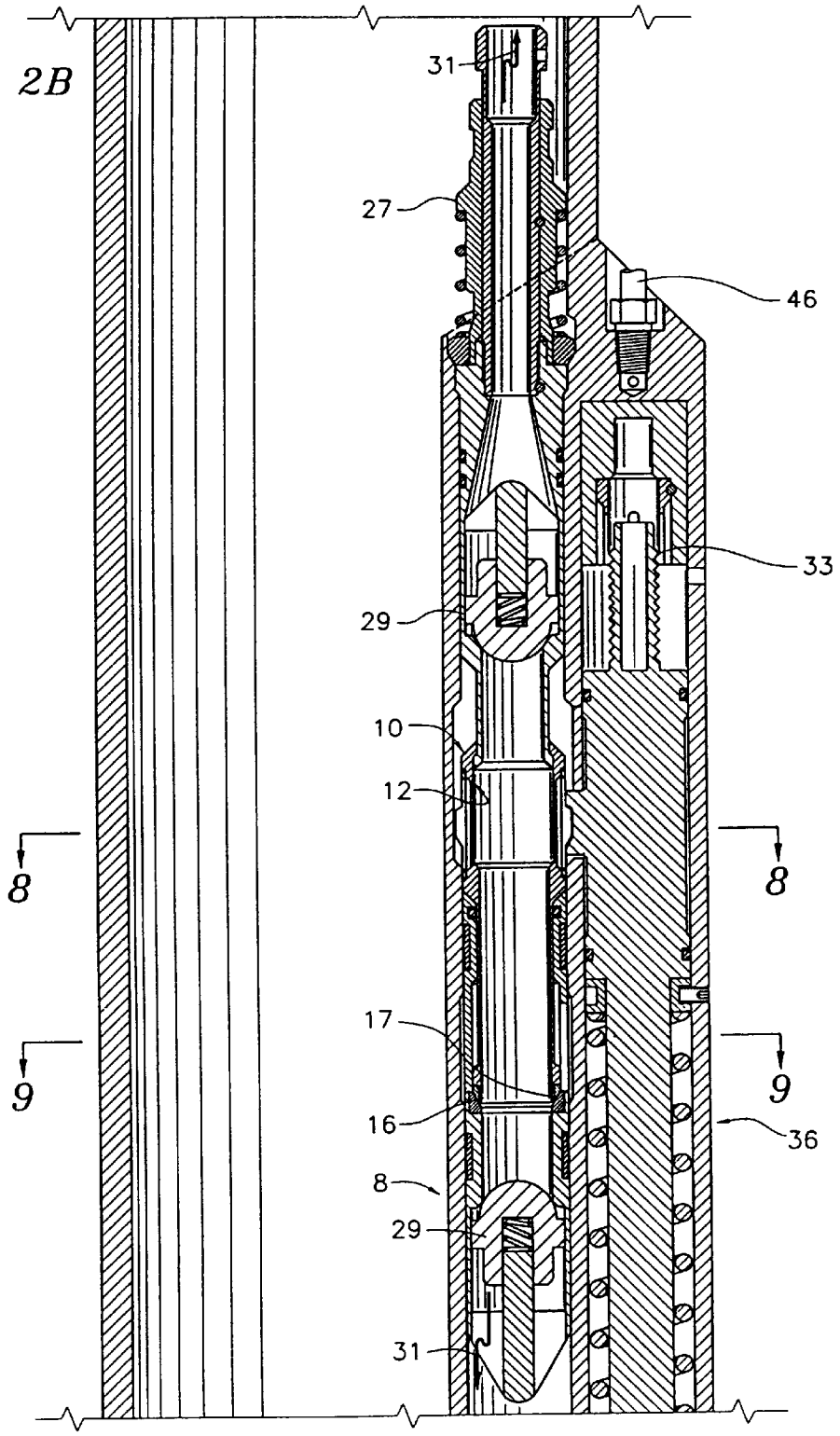
Figure 2C:
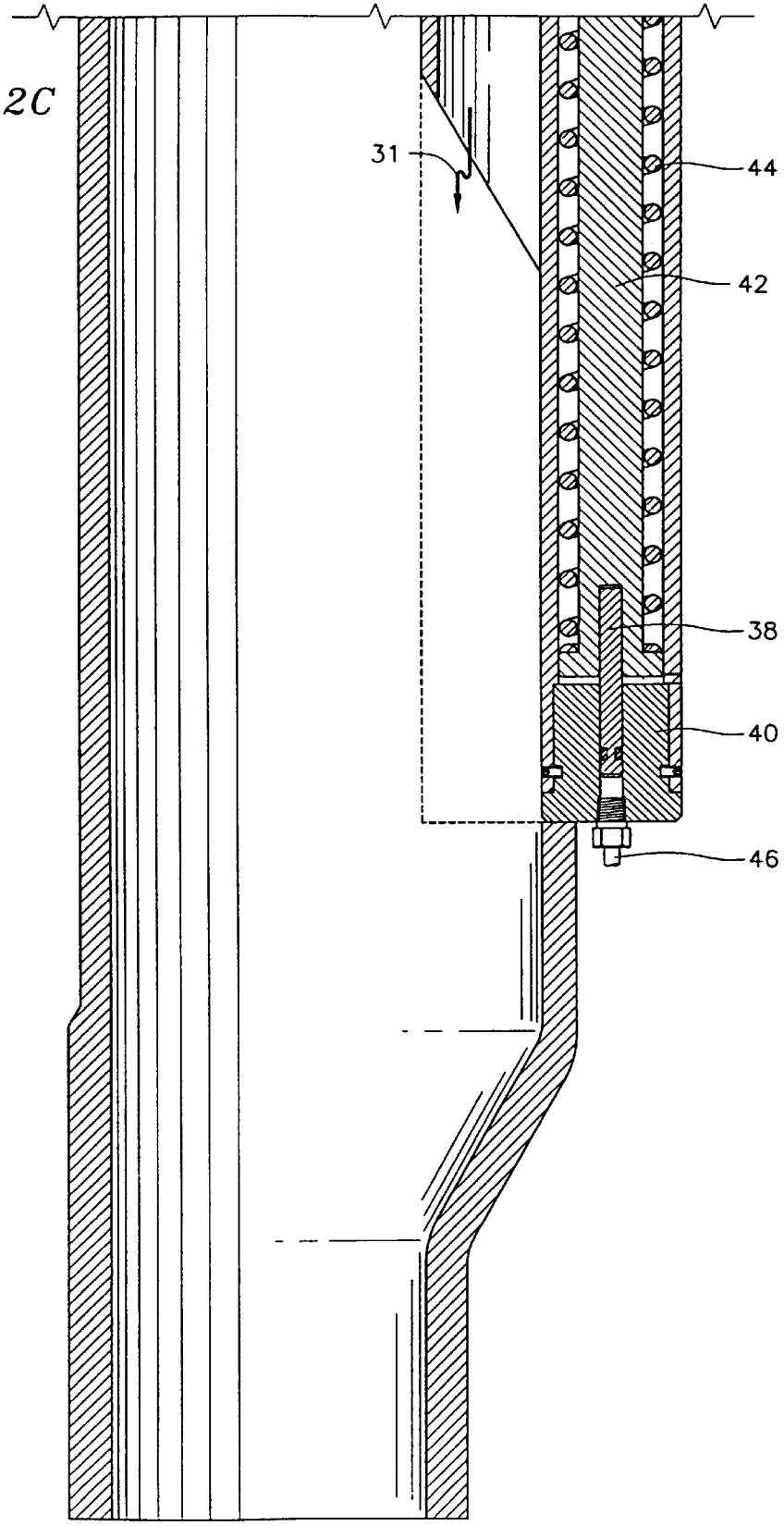
Figure 9:
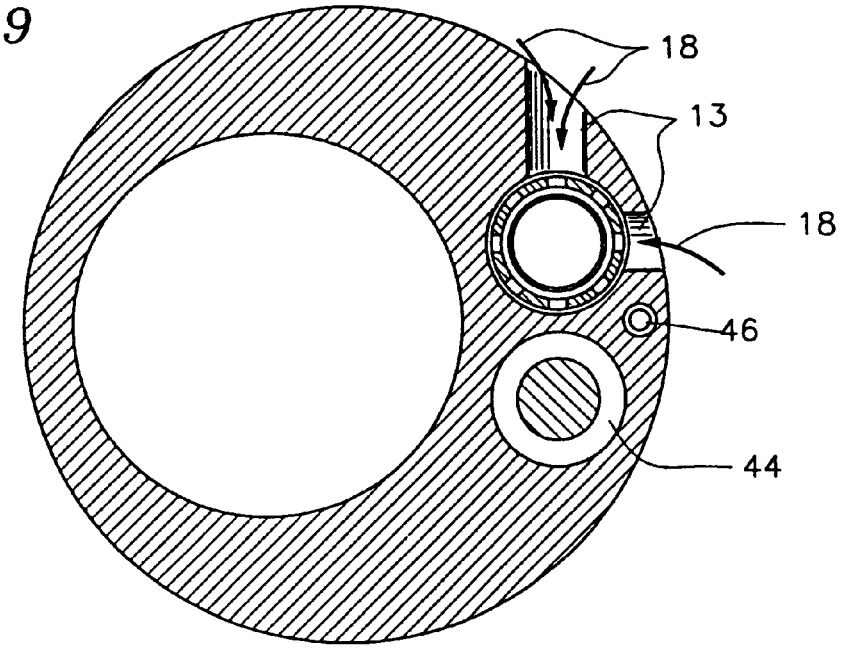
FIG. 9 is a cross-sectional view taken along line 9—9 of FIG. 2B.

FIGS. 2A–2C together depict a semidiagrammatic cross section of a gas lift valve 8 shown in the closed position, used in a subterranean well (not shown), illustrating: a valve body 10 with a longitudinal bore 12 for sealable insertion in a side pocket mandrel 14, a variable orifice valve 16 in the body 10 which alternately permits, prohibits, or throttles fluid flow (represented by item 18—see FIG. 9) into said body through injection gas ports 13 in the mandrel 14, and an actuating means shown generally by numeral 36 that is hydraulically operated. Further illustrated is: a hydraulic actuating piston 38 located in a downhole housing 40 and operatively connected to a moveable piston 42, which is operatively connected to the variable orifice valve 16. A spring 44, biases said variable orifice valve 16 in either the full open or full closed position, and a control line 46 communicates with the hydraulic actuating piston 38 and extends to a hydraulic pressure source (not shown). When it is operationally desirable to open the variable orifice valve 16, hydraulic pressure is applied from the hydraulic pressure source (not shown), which communicates down the hydraulic control line 46 to the hydraulic actuating piston 38, which moves the moveable piston 42, which opens the variable orifice valve 16. The variable orifice valve 16 may be stopped at intermediate positions between open and closed to adjust the flow of lift or injection gas 31 therethrough, and is held in place by a position holder 33 which is configured to mechanically assure that the actuating means 36 remains in the position where set by the operator if conditions in the hydraulic system change slightly in use. The valve is closed by releasing the pressure on the control line 46, allowing the spring 44 to translate the moveable piston 42, and the variable orifice valve 16 back to the closed position.

Figure 8:
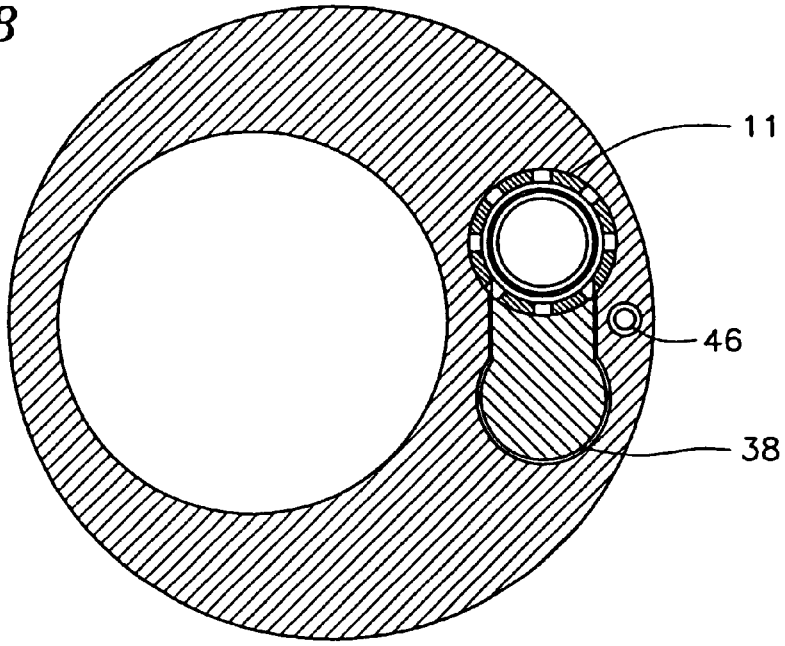
FIG. 8 is a cross-sectional view taken along line 8—8 of FIG. 2B.

As shown in FIG. 2B, the variable orifice valve 16 may include a carbide stem and seat 17. The gas lift valve 8 may also be provided with one-way check valves 29 to prevent any fluid flow from the well conduit into the gas lift valve 8. The gas lift valve 8 may also be provided with a latch 27 so the valve may be remotely installed and/or retrieved by well known wireline or coiled tubing intervention methods. As shown in FIG. 8, this embodiment of the present invention may also be provided with a valve connection collet 11, the structure and operation of which are well known to those of ordinary skill in the art.

Figure 3A:
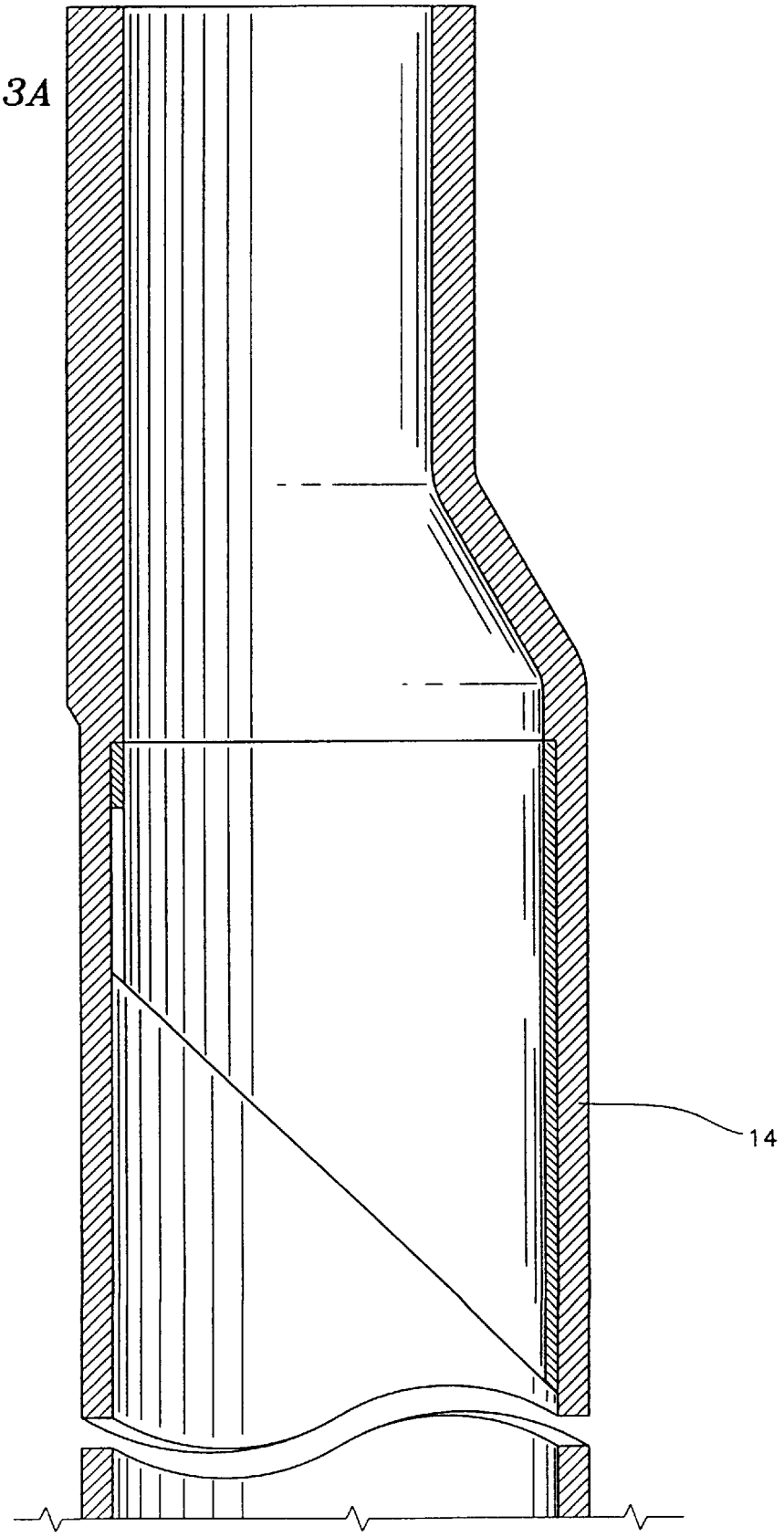
FIGS. 3A–3C are elevation views which together illustrate another hydraulically operated embodiment of the apparatus of the present invention connected to dual hydraulic control lines running from the earth's surface; the power unit is shown rotated ninety degrees for clarity.
Figure 3B:
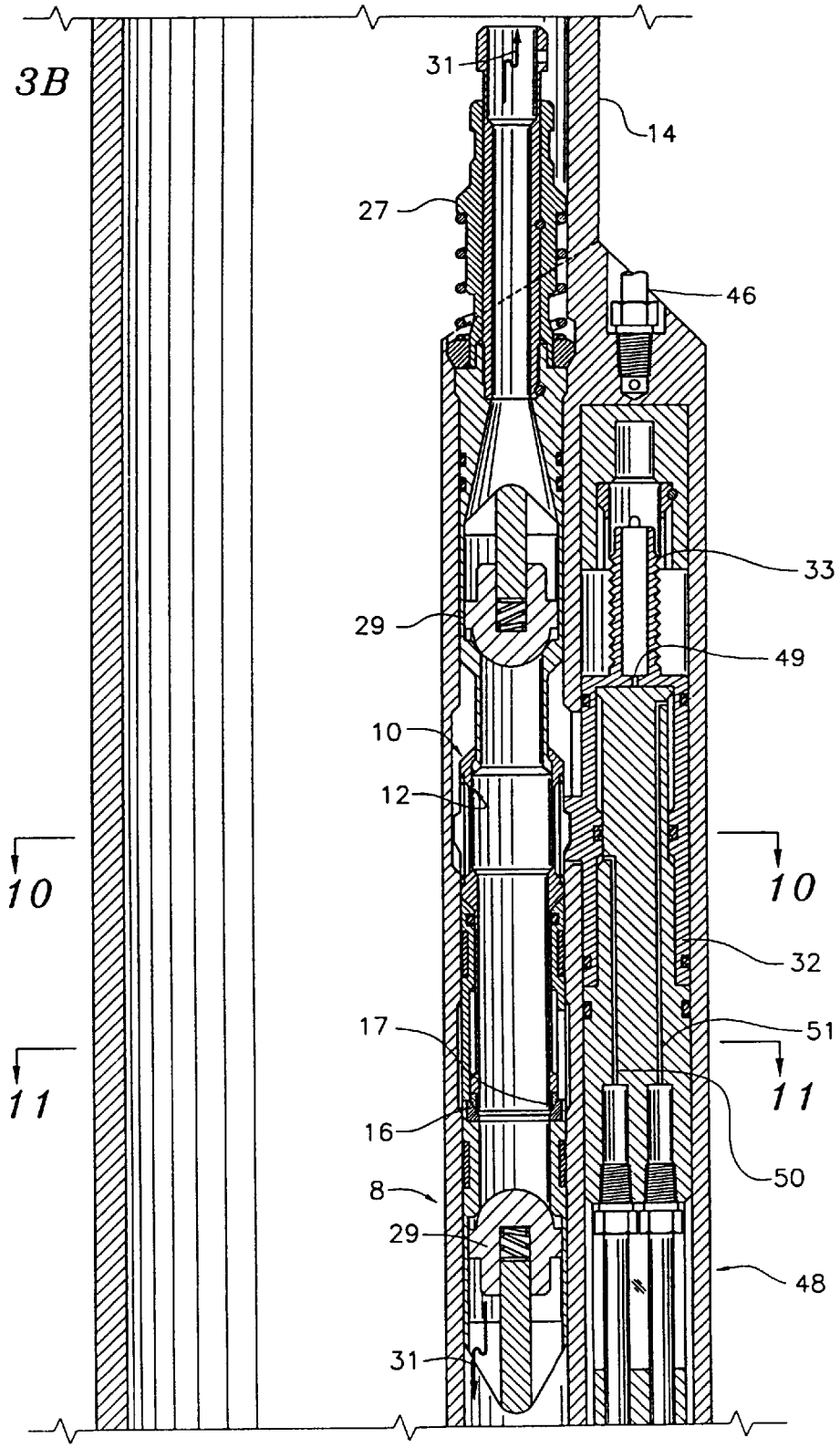
Figure 3C:
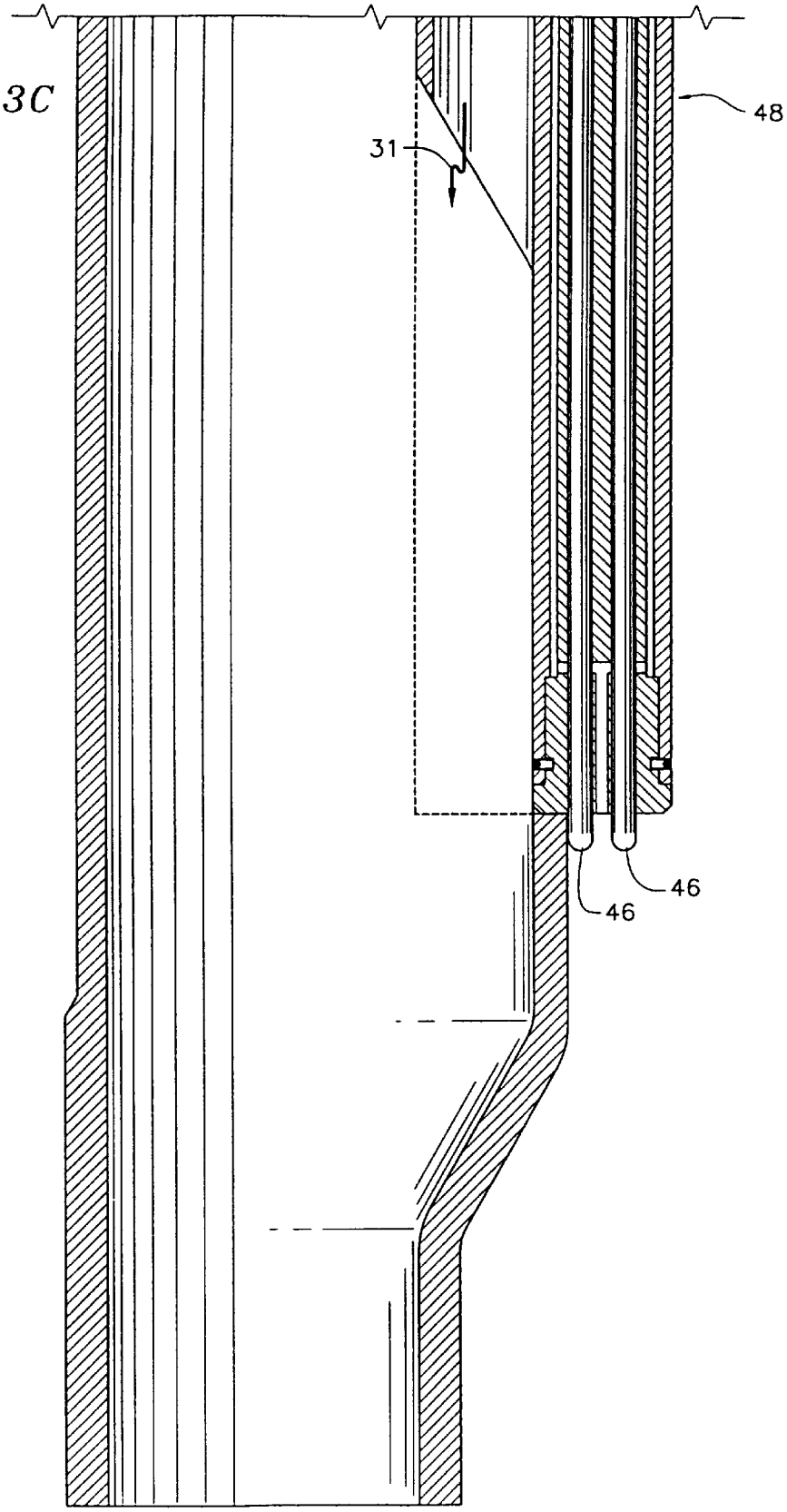
Figure 11:
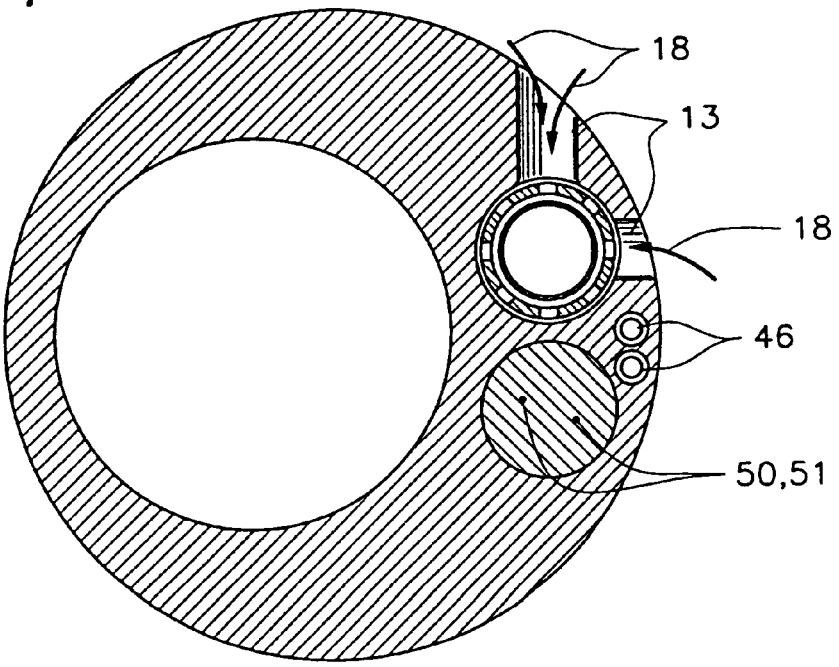
FIG. 11 is a cross-sectional view taken along line 11—11 of FIG. 3B.

FIGS. 3A–3C together disclose another embodiment of a semidiagrammatic cross section of a gas lift valve 8 shown in the closed position, used in a subterranean well (not shown), illustrating: a valve body 10 with a longitudinal bore 12 for sealable insertion in a side pocket mandrel 14, a variable orifice valve 16 in the body 10 which alternately permits, prohibits, or throttles fluid flow (represented by item 18—see FIG. 11) into said body through injection gas ports 13 in the mandrel 14, and an actuating means shown generally by numeral 48 that is hydraulically operated. Further illustrated: hydraulic conduits 50 and 51 that route pressurized hydraulic fluid directly to a moveable piston 32, which is operatively connected to the variable orifice valve 16. Two control lines 46 extend to a hydraulic pressure source (not shown). The moveable hydraulic piston 32 responding to the pressure signal from the "valve open" hydraulic conduit 50 which opens and controls the movement of the variable orifice valve 16 while the "valve closed" hydraulic conduit 51 is bled off. The variable orifice valve 16 may be stopped at intermediate positions between open and closed to adjust the flow of lift or injection gas 31 therethrough, and is held in place by a position holder 33 which is configured to mechanically assure that the actuating means 48 remains in the position where set by the operator if conditions in the hydraulic system change slightly in use. Closure of the variable orifice valve 16 is accomplished by sending a pressure signal down the "valve closed" hydraulic conduit 51, and simultaneously bleeding pressure from the "valve open" hydraulic conduit 50.

Figure 10:
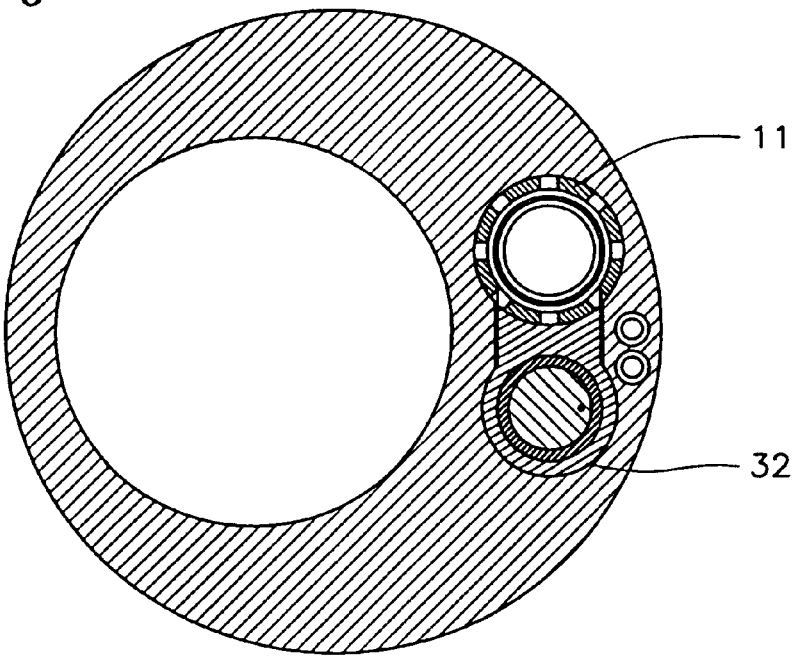
FIG. 10 is a cross-sectional view taken along line 10—10 of FIG. 3B.

A fluid displacement control port 49 may also be provided for use during the bleeding off of the conduits 50 and 51, in a manner well known to those of ordinary skill in the art. As shown in FIG. 3B, the variable orifice valve 16 may include a carbide stem and seat 17. The gas lift valve 8 may also be provided with one-way check valves 29 to prevent any fluid flow from the well conduit into the gas lift valve 8. The gas lift valve 8 may also be provided with a latch 27 so the valve may be remotely installed and/or retrieved by well known wireline or coiled tubing intervention methods. As shown in FIG. 10, this embodiment of the present invention may also be provided with a valve connection collet 11, the structure and operation of which are well known to those of ordinary skill in the art.

Figure 4A:
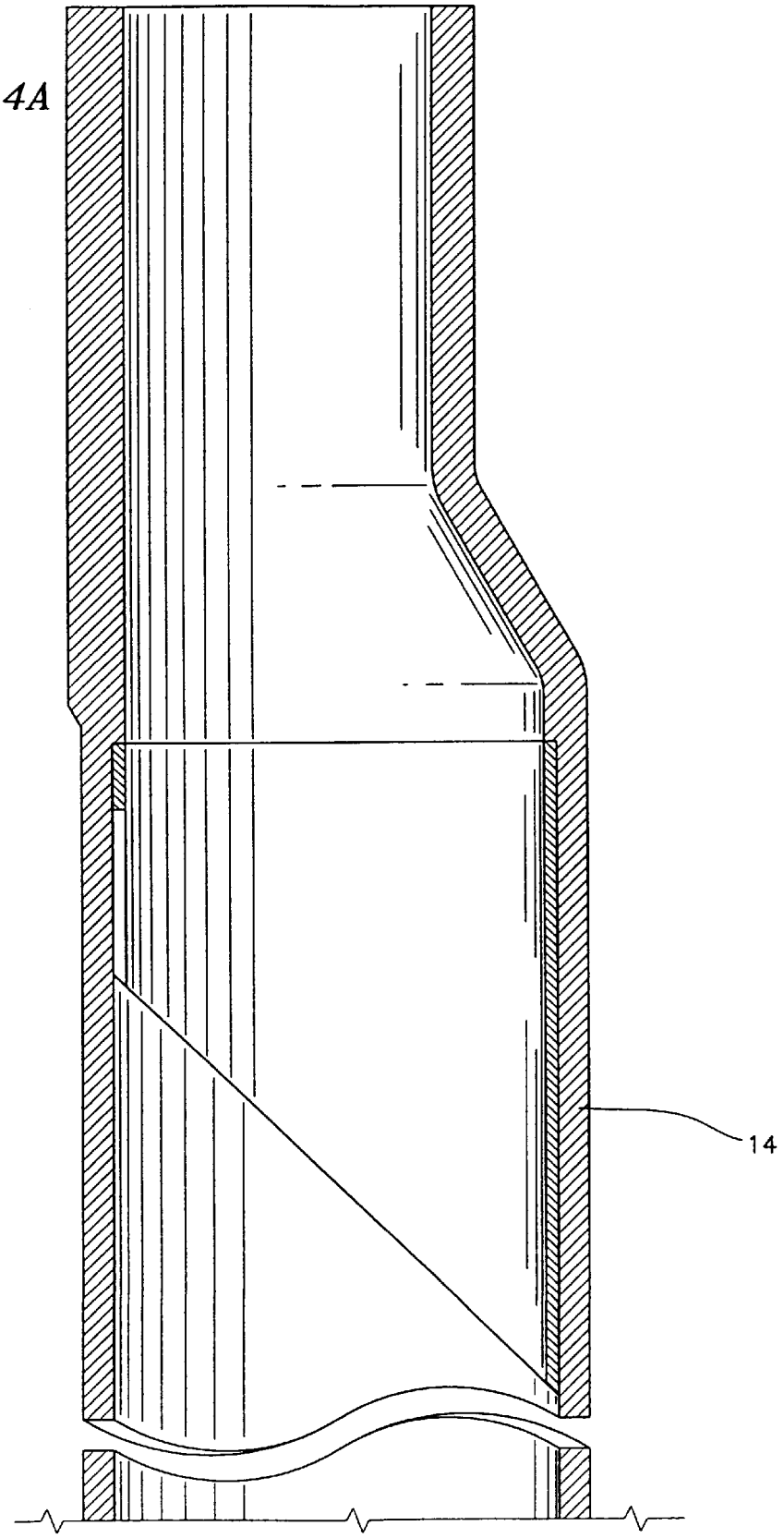
FIGS. 4A–4C are elevation views which together illustrate another hydraulically operated embodiment of the apparatus of the present invention connected to dual hydraulic control lines running from the earth's surface; the power unit is shown rotated ninety degrees for clarity.
Figure 4B:
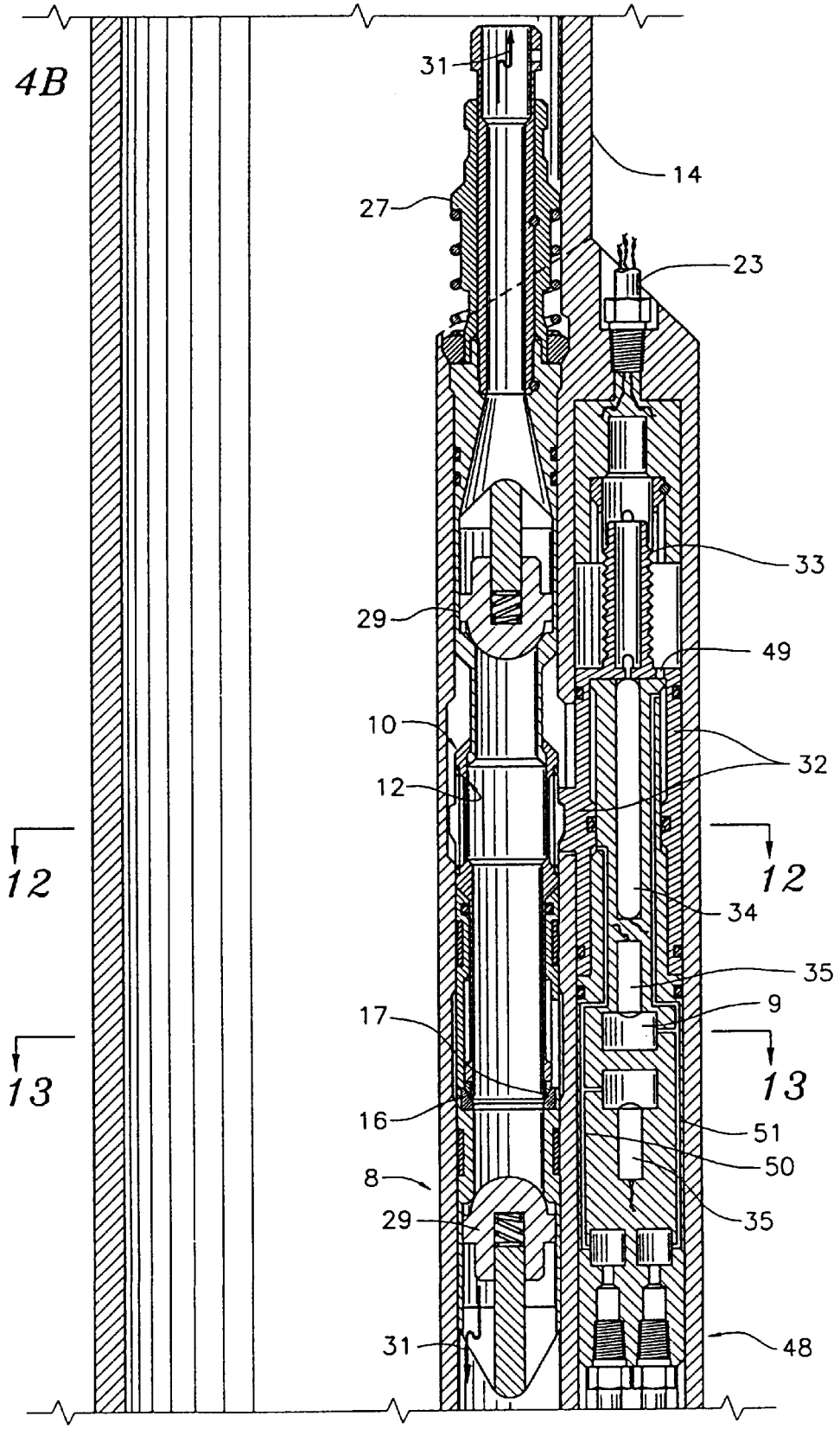
Figure 4C:
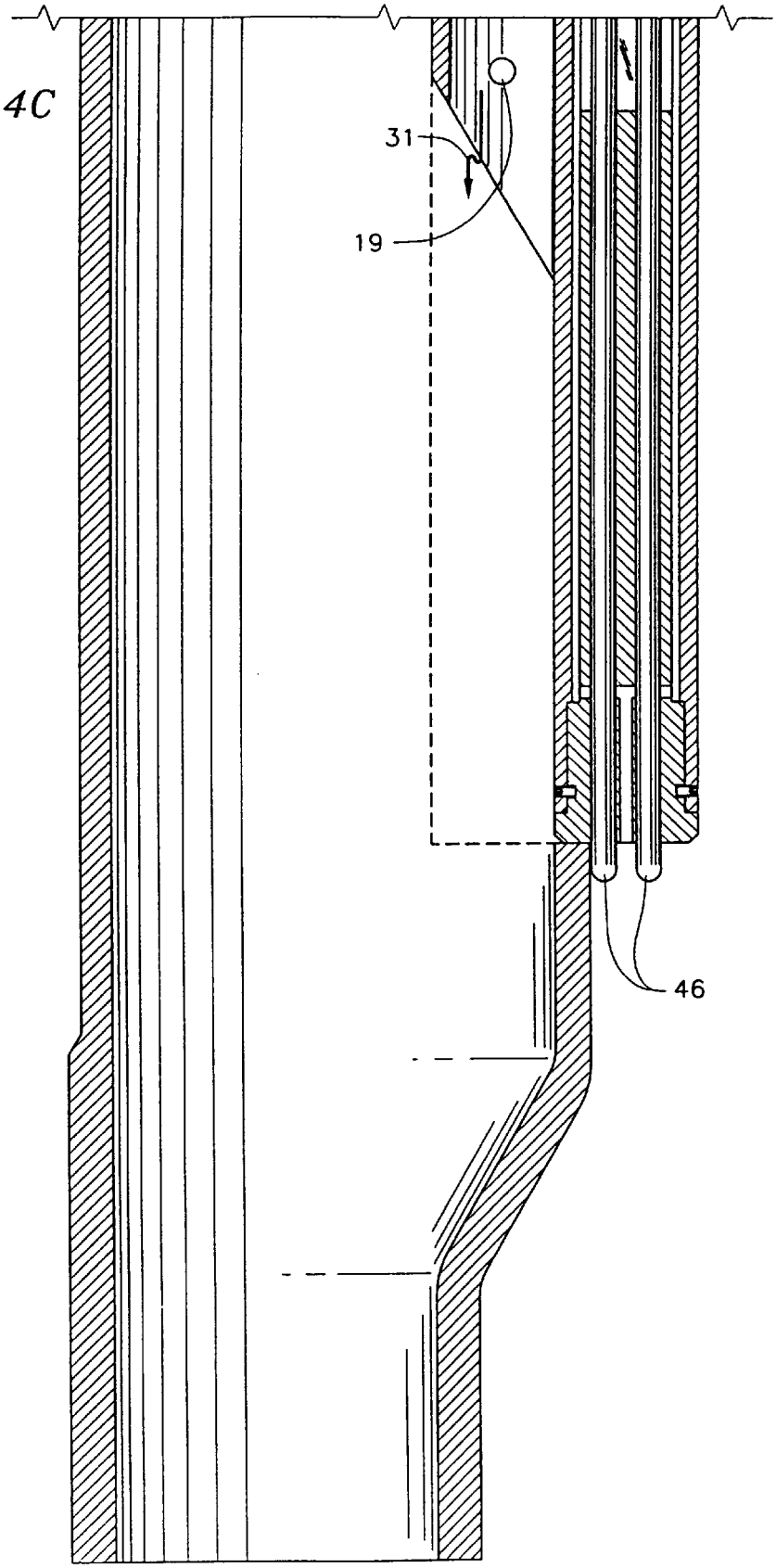
Figure 13:
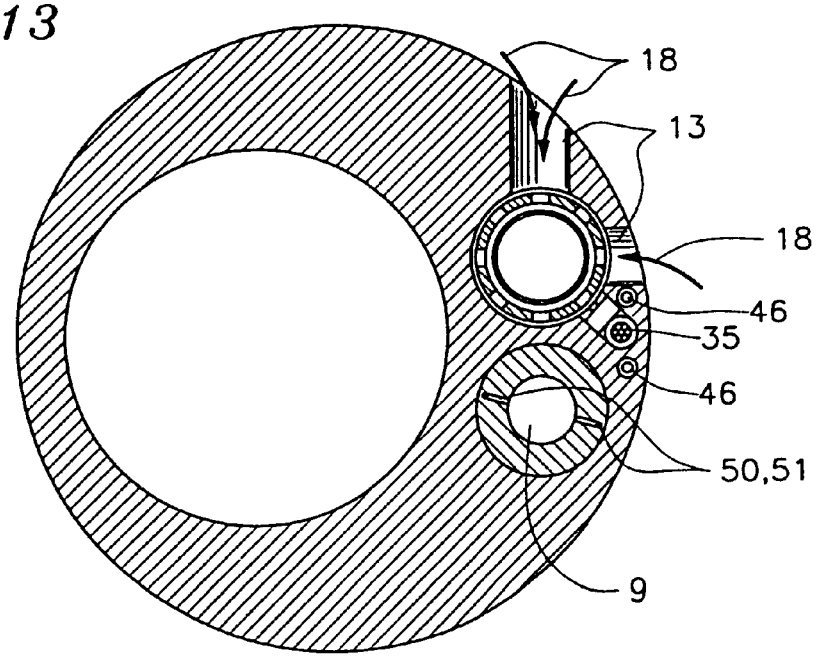
FIG. 13 is a cross-sectional view taken along line 13—13 of FIG. 4B.

FIGS. 4A–4C together depict a semidiagrammatic cross section of a gas lift valve 8 shown in the closed position, used in a subterranean well (not shown), illustrating: a valve body 10 with a longitudinal bore 12 for sealable insertion in a side pocket mandrel 14, a variable orifice valve 16 in the body 10 which alternately permits, prohibits, or throttles fluid flow (represented by item 18—see FIG. 13) into said body through injection gas ports 13 in the mandrel 14, and an actuating means shown generally by numeral 48 that is hydraulically operated. Further illustrated: hydraulic conduits 50 and 51 that route pressurized hydraulic fluid directly to a moveable piston 32, which is operatively connected to the variable orifice valve 16, and two control lines 46 extending to a hydraulic pressure source (not shown). The movable hydraulic piston 32 responding to the pressure signal from the "valve open" hydraulic conduit 50 which opens and controls the movement of the variable orifice valve 16 while the "valve closed" hydraulic conduit 51 is bled off. The variable orifice valve 16 may be stopped at intermediate positions between open and closed to adjust the flow of lift or injection gas 31 therethrough, and is held in place by a position holder 33 which is configured to mechanically assure that the actuating means 20 remains in the position where set by the operator if conditions in the hydraulic system change slightly in use. Closure of the variable orifice valve 16 is accomplished by sending a pressure signal down the "valve closed" hydraulic conduit 51, and simultaneously bleeding pressure from the "valve open" hydraulic conduit 50. The actuator has a position sensor 34 which reports the relative location of the moveable hydraulic piston 32 to the control panel (not shown) via an electrical conduit 23. Also shown are pressure transducers 35 communicating with the hydraulic conduits 50 and 51 through hydraulic pressure sensor chambers (e.g., conduit 51 communicates with chamber 9), and transmitting collected data to the control panel (not shown) via the electrical conduit 23.

Figure 12:
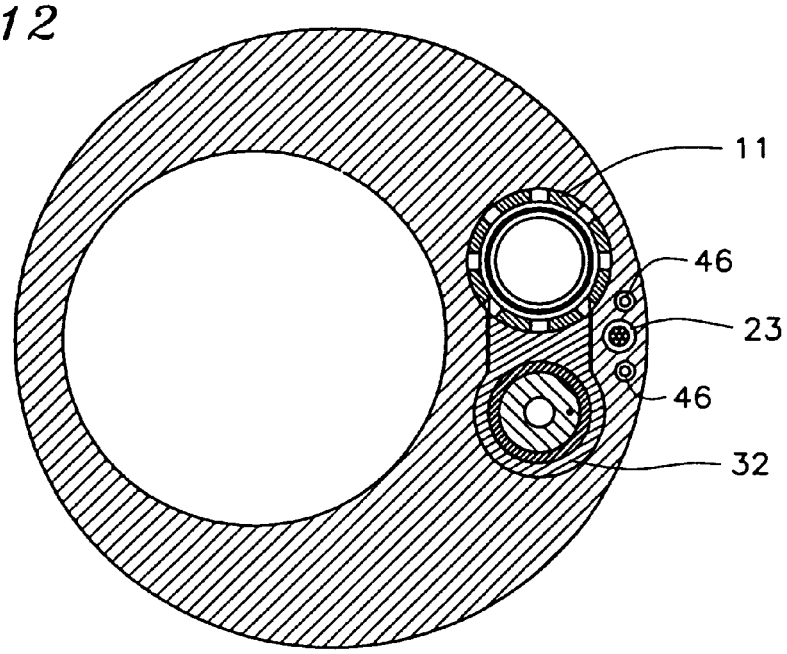
FIG. 12 is a cross-sectional view taken along line 12—12 of FIG. 4B.

As shown in FIG. 4C, a downstream pressure transducer 19 may be provided to cooperate with the pressure transducer 35 for measuring and reporting to the control panel any pressure drop across the variable orifice valve 16. As shown in FIG. 4B, a fluid displacement control port 49 may also be provided for use during the bleeding off of the conduits 50 and 51, in a manner well known to those of ordinary skill in the art. As also shown in FIG. 4B, the variable orifice valve 16 may include a carbide stem and seat 17. The gas lift valve 8 may also be provided with one-way check valves 29 to prevent any fluid flow from the well conduit into the gas lift valve 8. The gas lift valve 8 may also be provided with a latch 27 so the valve may be remotely installed and/or retrieved by well known wireline or coiled tubing intervention methods. As shown in FIG. 12, this embodiment of the present invention may also be provided with a valve connection collet 11, the structure and operation of which are well known to those of ordinary skill in the art.

Figure 5A:
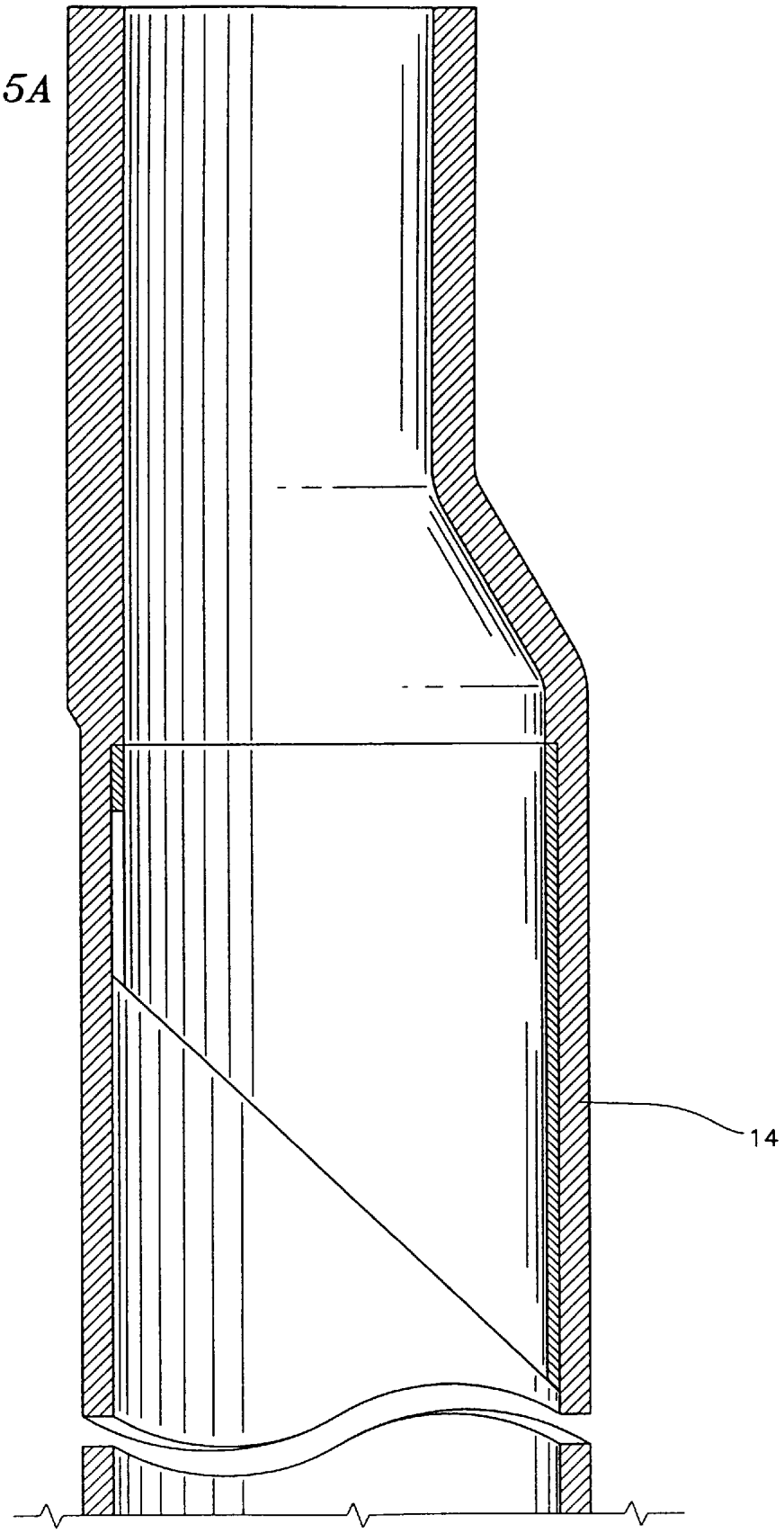
FIGS. 5A–5C are elevation views which together illustrate a pneumatic-hydraulically operated embodiment of the apparatus of the present invention connected to a single hydraulic control line running from the earth's surface; the power unit is shown rotated ninety degrees for clarity.
Figure 5B:
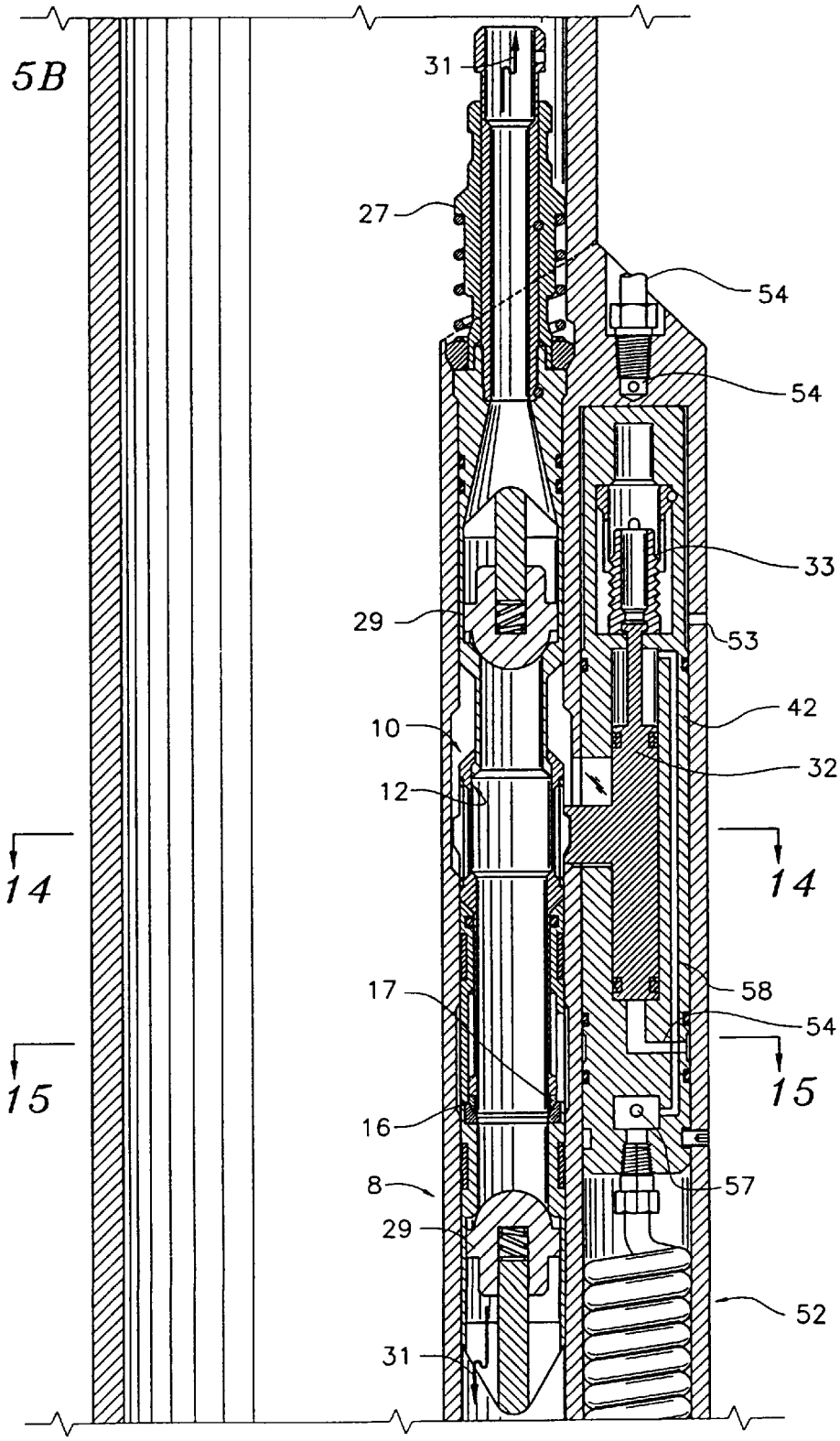
Figure 5C:
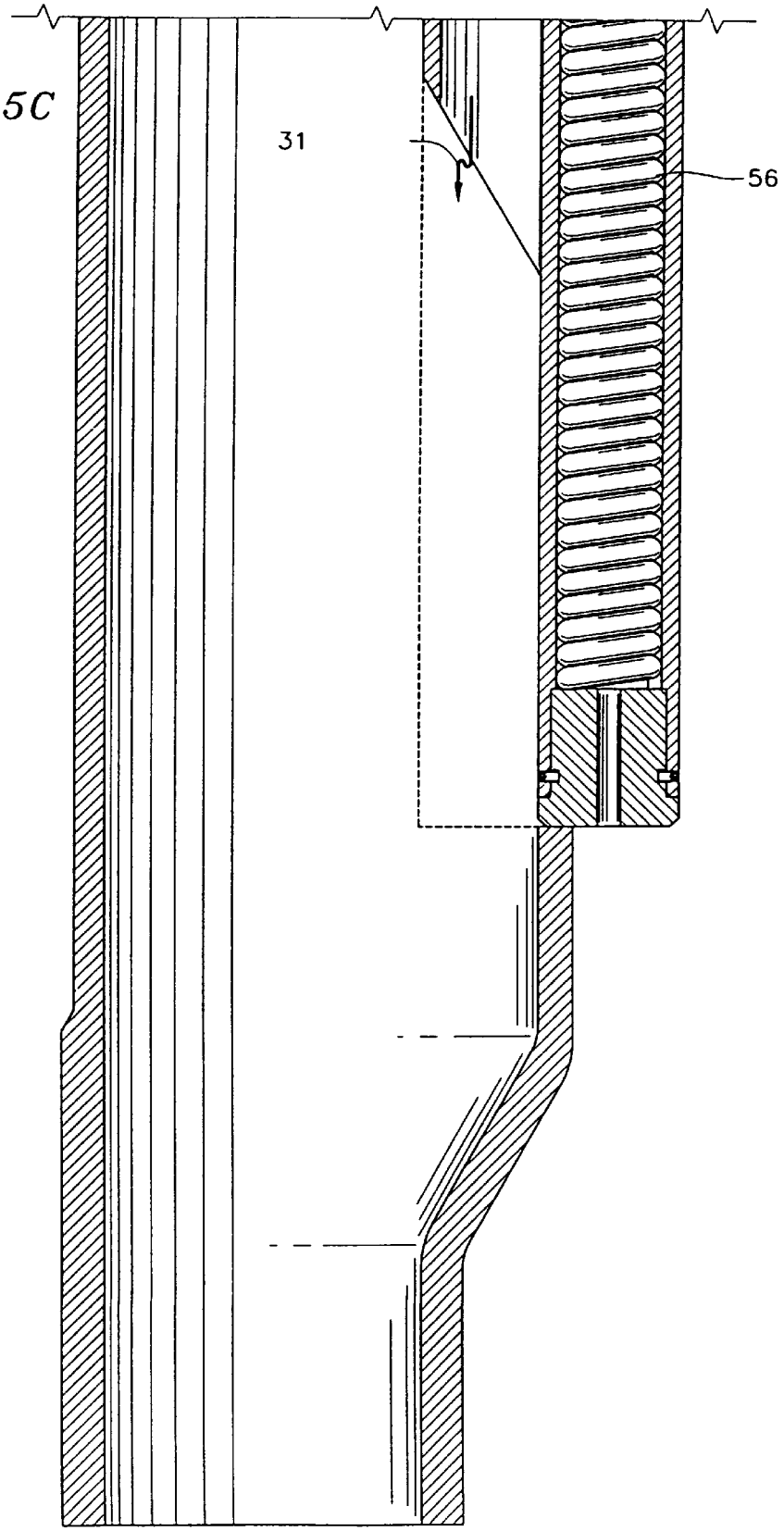
Figure 15:
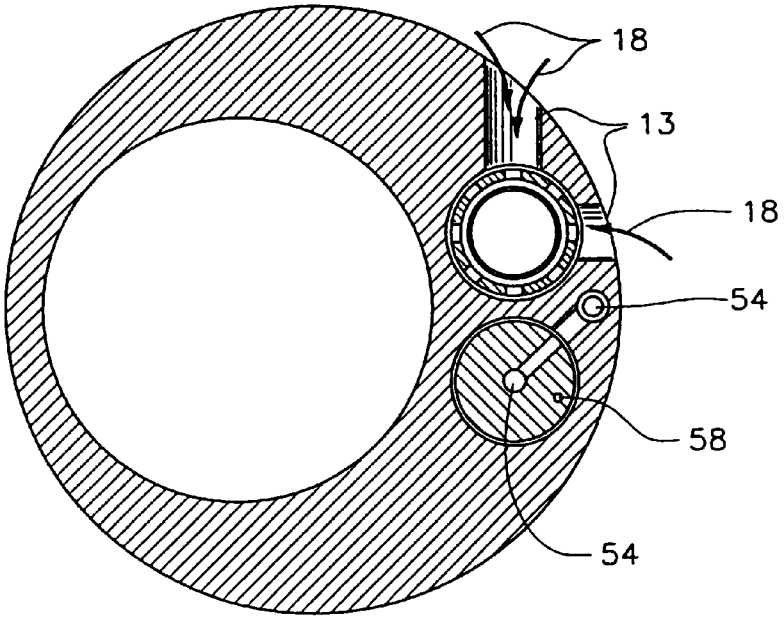
FIG. 15 is a cross-sectional view taken along line 15—15 of FIG. 5B.

FIGS. 5A—5C together depict a semidiagrammatic cross section of a gas lift valve 8 shown in the closed position, used in a subterranean well (not shown), illustrating: a valve body 10 with a longitudinal bore 12 for sealable insertion in a side pocket mandrel 14, a variable orifice valve 16 in the body 10 which alternately permits, prohibits, or throttles fluid flow (represented by item 18—see FIG. 15) into said body through injection gas ports 13 in the mandrel 14, and an actuating means shown generally by numeral 52 that is hydraulically operated. Further illustrated: a hydraulic conduit 54 that routes pressurized hydraulic fluid directly to a moveable piston 32, which is operatively connected to the variable orifice valve 16. Hydraulic pressure is opposed by a pressurized nitrogen charge inside of a nitrogen coil chamber 56, the pressure of which is routed through a pneumatic conduit 58, which acts on an opposite end of the moveable hydraulic piston 32, biasing the variable orifice valve 16 in the closed position. The nitrogen coil chamber 56 is charged with nitrogen through a nitrogen charging port 57. When it is operationally desirable to open the variable orifice valve 16, hydraulic pressure is added to the control line 54, which overcomes pneumatic pressure in the pneumatic conduit 58 and nitrogen coil chamber 56, and translates the moveable piston 32 upward to open the variable orifice valve 16. As before, the variable orifice valve 16 may be stopped at intermediate positions between open and closed to adjust the flow of lift or injection gas 31 therethrough, and is held in place by a position holder 33 which is configured to mechanically assure that the actuating means 52 remains in the position where set by the operator if conditions in the hydraulic system change slightly in use. Closing the variable orifice valve 16 is accomplished by bleeding off the pressure from the control line 54, which causes the pneumatic pressure in the nitrogen coil chamber 56 to close the valve because it is higher than the hydraulic pressure in the hydraulic conduit 54. An annulus port 53 may also be provided through the wall of the mandrel 14 through which pressure may be discharged to the annulus during operation.

Figure 14:
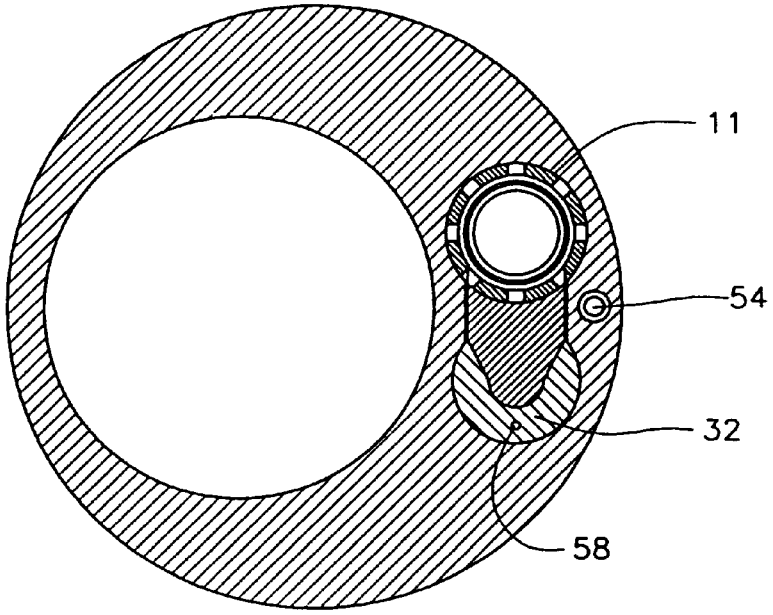
FIG. 14 is a cross-sectional view taken along line 14—14 of FIG. 5B.

As shown in FIG. 5B, the variable orifice valve 16 may include a carbide stem and seat 17. The gas lift valve 8 may also be provided with one-way check valves 29 to prevent any fluid flow from the well conduit into the gas lift valve 8. The gas lift valve 8 may also be provided with a latch 27 so the valve may be remotely installed and/or retrieved by well known wireline or coiled tubing intervention methods. As shown in FIG. 14, this embodiment of the present invention may also be provided with a valve connection collet 11, the structure and operation of which are well known to those of ordinary skill in the art.

Figure 16:
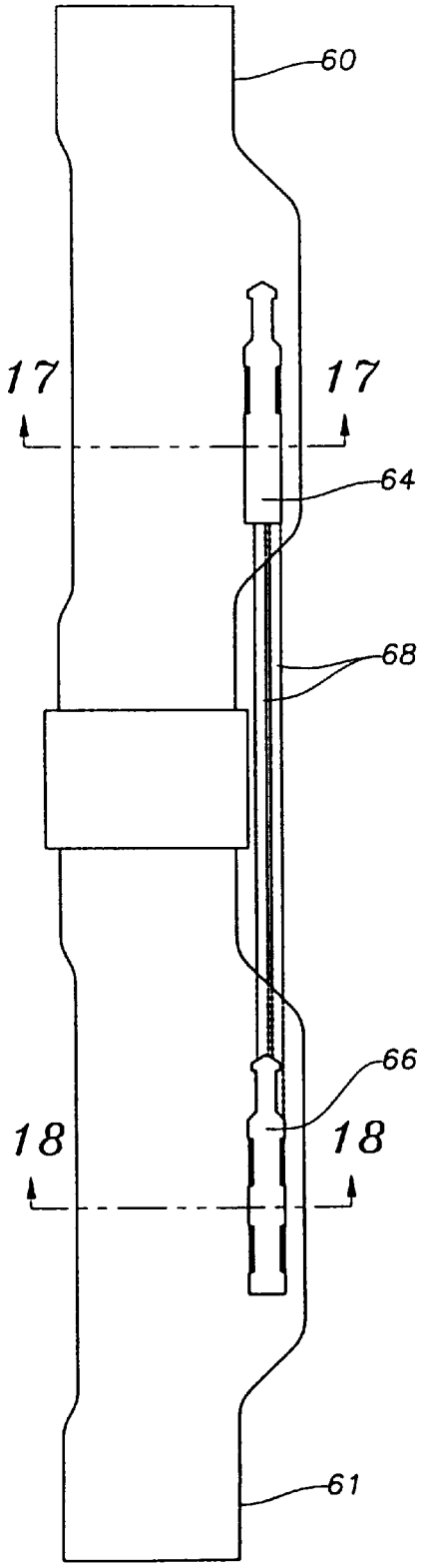
FIG. 16 is a schematic representation of another embodiment of the present invention with a retrievable actuator positioned in an upper mandrel and a retrievable variable orifice gas lift valve positioned in a lowermost mandrel.
Figure 17:
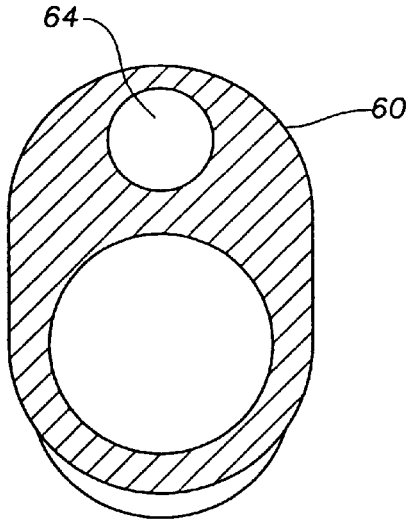
FIG. 17 is a cross-sectional view taken along line 17—17 of FIG. 16.
Figure 18:
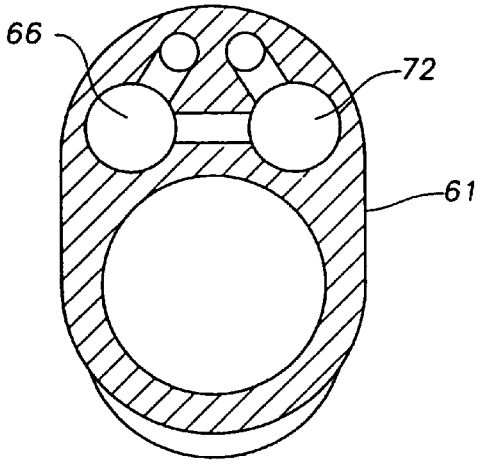
FIG. 18 is a cross-sectional view taken along line 18—18 of FIG. 16.

FIG. 16 is a schematic representation of one preferred embodiment of the present invention. Disclosed are uppermost and lowermost side pocket mandrels 60 and 61 sealably connected by a well coupling 62. A coiled tubing or wireline retrievable actuator 64 is positioned in the uppermost mandrel 60, and a variable orifice gas lift valve 66 is positioned in the lowermost mandrel 61, and are operatively connected by hydraulic control lines 68. In previous figures, the variable orifice valve 16 and the actuating mechanisms described in FIGS. 1–5 are shown located in the same mandrel, making retrieval of both mechanisms difficult, if not impossible. In this embodiment, the variable orifice gas lift valve 66, and the electro-hydraulic wireline or coiled tubing retrievable actuator 64 of the present invention are located, installed and retrieved separately, but are operatively connected one to another by hydraulic control lines 68. This allows retrieval of each mechanism separately, using either wireline or coiled tubing intervention methods which are well known in the art. As shown in FIG. 18, which is a cross-sectional view taken along line 18—18 of FIG. 16, an operating piston 72 is disposed adjacent the variable orifice valve 66 in the lowermost mandrel 61. In every other aspect, however, the mechanisms operate as heretofore described.

It should be noted that the preferred embodiments described herein employ a well known valve mechanism generically known as a poppet valve to those skilled in the art of valve mechanics. It can, however, be appreciated that several well known valve mechanisms may obviously be employed and still be within the scope and spirit of the present invention. Rotating balls or plugs, butterfly valves, rising stem gates, and flappers are several other generic valve mechanisms which may obviously be employed to accomplish the same function in the same manner.

Whereas the present invention has been described in particular relation to the drawings attached hereto, it should be understood that other and further modifications, apart from those shown or suggested herein, may be made within the scope and spirit of the present invention. Accordingly, the invention is therefore to be limited only by the scope of the appended claims.

I claim:

1. A method of using a valve in a subterranean well, comprising:

installing a first mandrel in a well production;

installing a variable orifice valve in the first mandrel;

installing a controllable actuator in a housing external to the first mandrel; and, controlling the variable orifice valve by controlling the actuator from the surface.

2. The method of claim 1, wherein the variable orifice valve is retrievably installed in the first mandrel.

3. The method of claim 1, wherein the actuator is installed in a second mandrel that is in operational communication with the first mandrel.

4. The method of claim 1, wherein the method of installing the variable orifice valve and the actuator is by wireline intervention.

5. The method of claim 1, wherein the method of installing the variable orifice valve and the actuator is by coiled tubing intervention.

6. The method of claim 1, wherein the valve is a gas lift valve.

7. A valve for variably controlling the flow of a fluid through a mandrel, comprising:

a first mandrel being installed in a well production string;

a valve having a variable orifice installed in the first mandrel, the valve for controlling flow of the fluid through the mandrel; and an actuating piston for controlling the valve, the actuating piston being installed in the first mandrel, in communication with and controllable from an actuator installed in a housing external to the first mandrel.

8. The valve of claim 7, wherein the actuator is installed in a second mandrel that is included in the well production string and that is connected to the first mandrel.

9. The valve of claim 7, wherein the valve and the actuator are remotely deployed and retrieved.

10. The valve of claim 9, wherein the valve and the actuator are remotely deployed and retrieved by utilization of coiled tubing.

11. The valve of claim 9, wherein the valve and the actuator are remotely deployed and retrieved by utilization of wireline.

12. The valve of claim 7, wherein the valve comprises a gas lift valve and the fluid comprises a gas.

13. A method of using a valve in a subterranean well, comprising:

installing a first mandrel in a well production;

installing a variable orifice valve in the first mandrel;

installing a controllable actuator external to the first mandrel; and, controlling the variable orifice valve by controlling the actuator from the surface.

14. The method of claim 13, wherein the valve comprises a gas lift valve.

15. A valve for variably controlling the flow of a fluid through a mandrel, comprising:

a first mandrel being installed in a well production string;

a valve having a variable orifice installed in the first mandrel, the valve for controlling flow of the fluid through the mandrel; and an actuator for controlling the valve, the actuator being installed external to the first mandrel, in communication with and controllable from a control panel, and connected to the valve by a first and second hydraulic control line.

16. The valve of claim 15, wherein the valve comprises a gas lift valve and the fluid comprises a gas.

* * * * *